US006920861B2

(12) United States Patent
Hayakawa et al.

(10) Patent No.: US 6,920,861 B2
(45) Date of Patent: Jul. 26, 2005

(54) FUEL INJECTION CONTROL DEVICES FOR INTERNAL COMBUSTION ENGINES

(75) Inventors: Masaya Hayakawa, Obu (JP); Kazuhiro Yoneshige, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/846,540

(22) Filed: May 17, 2004

(65) Prior Publication Data

US 2004/0261761 A1 Dec. 30, 2004

(30) Foreign Application Priority Data

Jun. 30, 2003 (JP) ..... 2003-186496

(51) Int. Cl.[7] ..... F02B 17/00; F02B 23/00; F02M 61/18

(52) U.S. Cl. ..... 123/295; 123/458; 123/557; 123/585

(58) Field of Search ..... 123/295, 457, 123/458, 531, 532, 533, 557, 585

(56) References Cited

U.S. PATENT DOCUMENTS 4,465,050 A * 8/1984 Igashira et al. ..... 123/585
4,932,374 A * 6/1990 Klomp et al. ..... 123/531
5,129,381 A * 7/1992 Nakajima ..... 123/531
5,148,788 A * 9/1992 Saikalis et al. ..... 123/585
5,241,938 A * 9/1993 Takagi et al. ..... 123/585
5,255,658 A * 10/1993 Hoffer et al. ..... 123/531
6,095,113 A * 8/2000 Nogi et al. ..... 123/295
6,564,770 B1 * 5/2003 Cathcart ..... 123/531
6,571,781 B2 * 6/2003 Cho et al. ..... 123/585

FOREIGN PATENT DOCUMENTS

JP A 10-318096 12/1998
JP A 2000-97030 4/2000
JP A 2002-161790 6/2002

* cited by examiner

*Primary Examiner*—Tony M. Argenbright
(74) *Attorney, Agent, or Firm*—Oliff & Berridge PLC

(57) ABSTRACT

A fuel injection device includes a fuel injection valve for injecting fuel through a fuel injection orifice opening into a combustion chamber, an air injection valve for injecting air through an air injection orifice opening into the combustion chamber, sensors for detecting an operating condition of an engine, and an electronic control unit (ECU) for controlling the fuel injection valve and the air injection valve. Orientations of the air injection orifice and the fuel injection orifice are determined to make an air jet collide with a fuel spray. The ECU controls the fuel injection valve based on the operating condition detected by the sensors to control spray velocity, spray particle diameter, spray angle, etc. of the fuel to be injected through the fuel injection orifice, and at least one of an air injection timing and an air injection period of air injection to be performed by the air injection valve.

26 Claims, 23 Drawing Sheets

FUEL SPRAY

ONE AIR JET
(FREE JET)

PERIPHERAL AIR JETS
(MULTI-ORIFICE JETS)

FUEL SPRAY

ONE AIR JET
(FREE JET)

PERIPHERAL AIR JETS
(MULTI-ORIFICE JETS)

FIG. 13

| Operating Conditions | ① Low temperature starting operation | ② Partial load operation | ③ Full load operation |
|---|---|---|---|
| a) Combustion Pattern | Warm-up Combustion | Stratified Charge Combustion | Uniform Combustion |
| b) Fuel/air injection periods | Same period | Air injection period is longer. | Air injection period is somewhat longer. |
| c) Fuel/air injection timing difference | Same timing | Air injection timing precedes. | Air injection timing somewhat precedes. |
| d) Spray penetration distance | Short | Long | Medium |
| e) Spray velocity at collision with wall surface (distance to wall surface) | Low (Long) | High (Short) | Medium (Long) |
| f) Spray particle diameter | Small | Small | Small |
| g) Spray shape | Large spray angle | Small spray angle | Medium spray angle |

FIG. 14A
FIG. 14B
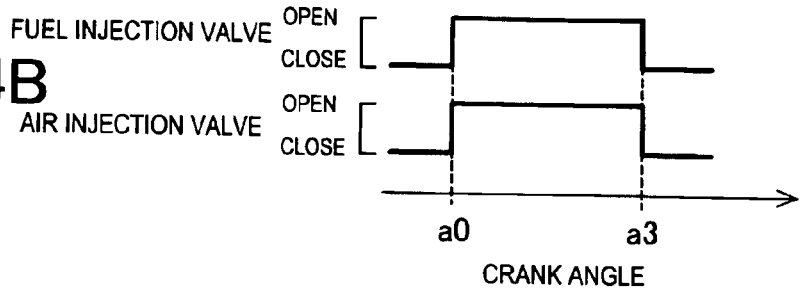
FIG. 15A
FIG. 15B
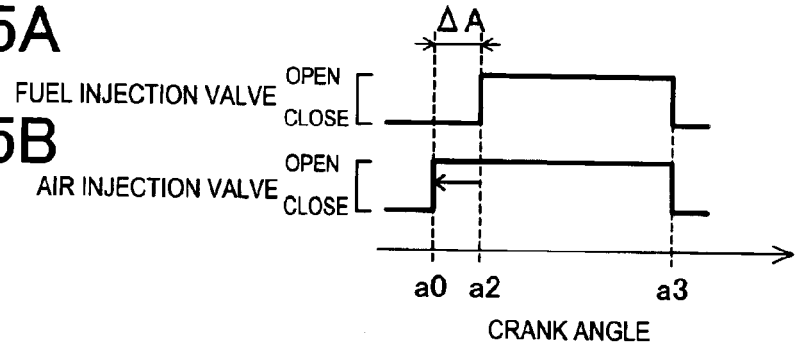
FIG. 16A
FIG. 16B
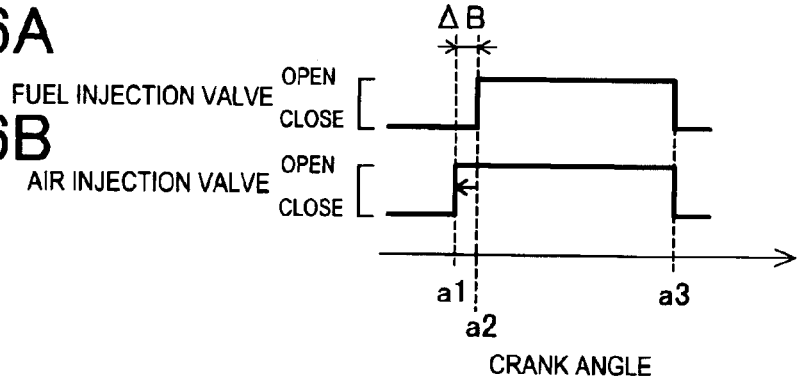

FUEL SPRAY WITH NO AIR INJECTION

FUEL SPRAY WITH AIR INJECTION PRECEDING FUEL INJECTION BY "1.0 ms"

FUEL SPRAY WITH AIR INJECTION PRECEDING FUEL INJECTION BY "2.0 ms"

FIG. 27

| Operating Conditions | ① Low temperature starting operation | ② Partial load operation | ③ Full load operation |
|---|---|---|---|
| a) Combustion Pattern | Warm-up Combustion | Stratified Charge Combustion | Uniform Combustion |
| b) Fuel temperature | High | Low | Medium |
| c) Spray penetration distance | Short | Long | Medium |
| d) Spray velocity at collision with wall surface (distance to wall surface) | Low (Long) | High (Short) | Medium (Long) |
| e) Spray particle diameter | Small | Large (Standard) | Medium |
| f) Spray shape | Large spray angle | Small spray angle (Standard) | Medium spray angle |

FIG. 30

| Operating Conditions | ① Low temperature starting operation | ② Partial load operation | ③ Full load operation |
|---|---|---|---|
| a) Combustion Pattern | Warm-up Combustion | Stratified Charge Combustion | Uniform Combustion |
| b) Fuel pressure | Low | High | Medium |
| c) Spray penetration distance | Short | Long | Medium |
| d) Spray velocity at collision with wall surface (distance to wall surface) | Low (Long) | High (Short) | Medium (Long) |
| e) Spray particle diameter | Large (Standard) | Small | Medium |
| f) Spray shape | Standard | Standard | Standard |

FUEL INJECTION CONTROL DEVICES FOR INTERNAL COMBUSTION ENGINES

BACKGROUND OF THE INVENTION

1. Field of the Invention

The present invention relates to a fuel injection control device for a direct injection type internal combustion engine adapted to directly inject fuel into a combustion chamber in an internal combustion engine. More particularly, the present invention is concerned with a fuel injection control device constructed such that a fuel spray is supplied in conformity with an operating condition of the internal combustion engine.

2. Description of Related Art

Relating to direct injection type internal combustion engines, heretofore, fuel injection control devices adapted to supply fuel in a spray form appropriate for an operating condition of the engines are disclosed for example in Japanese patent unexamined publication No. 2000-97030 (pages 4–6 and FIG. 3), Japanese patent unexamined publication No. Hei 10-318096 (page 9 and FIG. 7), and Japanese patent unexamined publication No. 2002-161790 (pages 2–5 and FIGS. 1–6).

The above '030 document discloses a cylinder injection (direct injection) type internal combustion engine and a fuel injection valve for cylinder injection are disclosed. In this document, it is also described that the internal combustion engine constructed to switch an operating mode between a premix combustion mode and a stratified charge combustion mode is adapted to change fuel spray characteristics according to the selected operating mode. More specifically, it is arranged that a fuel spray from the fuel injection valve takes a spray pattern having a substantially axis-symmetric shape with respect to a nozzle hole axis for a first predetermined distance from the nozzle hole and another spray pattern having a substantially point-symmetric or line-symmetric shape in which a sectional shape perpendicularly intersecting the nozzle hole axis spreads in one direction perpendicularly intersecting the nozzle hole axis, for a second predetermined distance or more longer than the first predetermined distance. In the operating mode of the stratified charge combustion, a fuel spray is formed in about the first predetermined distance during a compression stroke of a piston. In the operating mode of the premix combustion, a fuel spray is formed in about the second predetermined distance or more during a suction stroke of the piston.

The '096 document discloses a fuel injection valve capable of injecting a so-called composite spray (a solid spray) including a fuel spray for good combustibility and a fuel spray for good ignitability, and also an internal combustion engine using the fuel injection valve. More specifically, it describes a fuel injection valve provided with a nozzle body having an injection hole, a valve body, and drive means for driving the valve body in its axial direction in order to produce, as the solid spray, a spray with a short fuel spray travel and an increased spray angle by decreasing an inertia force and a spray with a decreased spray angle by increasing the inertia force. This fuel injection valve is constructed such that two turning force giving means for giving a turning force to fuel are axially arranged upstream from the injection hole and a first turning force giving means and a second turning force giving means of the two turning force giving means are different in structure.

The '790 document discloses a combustion control device for a direct injection/spark ignition type internal combustion engine. This device is provided with a fuel injection valve for directly injecting fuel into a combustion chamber and a spark plug. The device is constructed to selectively conduct a stratified charge operation in which a spray is concentrated near the spark plug and a uniform operation in which a spray is uniformly dispersed throughout the combustion chamber. This document also describes separate injection control means which executes fuel injections several times per one cycle during the uniform operation. This separate injection control means makes a time interval between injections and a rate of injection quantity variable according to a rotational speed of the internal combustion engine and a load on the engine.

In general, a fuel spray pattern (a fuel spray which an air-fuel mixture is collected up near the spark plug) required for the stratified charge combustion and a fuel spray pattern (a high dispersion fuel spray which an air-fuel mixture is dispersed throughout the combustion chamber) required for the uniform combustion have opposite characteristics. The devices disclosed in the above documents '030 and '096, however, could realize only one fuel spray pattern similar to the fuel spray pattern for the stratified charge combustion. Specifically, it is impossible to effectively achieve the uniform combustion and to select one from two or more combustion patterns, so that engine performances could not be improved.

In the device disclosed in the document '790, fuel injections are performed in several times, leading to plural transient response times of the injection valve, during which fuel atomization would deteriorate. This results in an increase in diameter of a fuel spray particle, which decreases resistance of the air to the fuel spray and thus increases a fuel spray travel (distance). Further, the fuel spray travel has a large influence mainly on an injection quantity (an injection rate) per unit of time. Accordingly, this device could not easily shorten the fuel spray travel as mentioned above even if the fuel injections are performed in numbers. In the uniform combustion, when an engine rotational speed is low at for example idle engine operation, the time intervals for plural injections can be provided. However, when the engine rotational speed is high at full-load engine operation, there is not sufficient time for plural injections. The device in the document '790 have to inject a large quantity of fuel and therefore could not provide a fuel spray adequate for the above mentioned uniform combustion by the plural injections.

SUMMARY OF THE INVENTION

The present invention has been accomplished in view of the above-mentioned circumstances and it is a first object of the invention to provide a fuel injection control device for internal combustion engines which change a combustion pattern according to an operating condition, the fuel injection control device being capable of improving engine performances such as fuel economy, exhaust emission, and engine power by supplying a fuel spray appropriate for an operating condition of the internal combustion engine.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a fuel injection control device which is used in an internal combustion engine of a direct injection type in which fuel is directly injected into a combustion chamber, the fuel injection control device being adapted to selectively switch between a stratified charge combustion mode of collecting a fuel spray near a spark plug provided in the combustion chamber and a uniform combustion mode of uniformly dispersing a fuel pray throughout the combustion chamber, the fuel injection control device comprising: at least one of spray velocity changing means for changing a velocity of the fuel spray, spray particle diameter changing means for changing a particle diameter of the fuel spray, and spray angle changing means for changing an angle of the fuel spray.

According to another aspect, the present invention provides a fuel injection control device which is used in an internal combustion engine of a direct injection type in which fuel is directly injected into a combustion chamber, the fuel injection control device being adapted to selectively switch between a stratified charge combustion mode of collecting a fuel spray near a spark plug provided in the combustion chamber and a uniform combustion mode of uniformly dispersing a fuel pray throughout the combustion chamber, the fuel injection control device comprising: spray velocity changing means for changing a velocity of the fuel spray; spray particle diameter changing means for changing a particle diameter of the fuel spray; and spray angle changing means for changing an angle of the fuel spray.

BRIEF DESCRIPTION OF THE DRAWINGS

FIG. 13 is a table showing a relation between engine operating conditions and combustion patterns and others;

FIGS. 14A and 14B are time charts showing an opening/closing timing of a fuel injection valve and that of an air injection valve;

FIGS. 15A and 15B are time charts showing an opening/closing timing of the fuel injection valve and that of the air injection valve;

FIGS. 16*a* and 16B are time charts showing an opening/closing timing of the fuel injection valve and that of the air injection valve;

FIG. 27 is a table showing a relation between engine operating conditions and combustion patterns;

FIG. 30 is a table showing a relation between engine operating conditions and combustion patterns.

DETAILED DESCRIPTION OF THE PREFERRED EMBODIMENTS

[First Embodiment]

A fuel injection control device for an internal combustion engine according to a first embodiment of the present invention will be described below in detail with reference to accompanying drawings.

Figure 1:
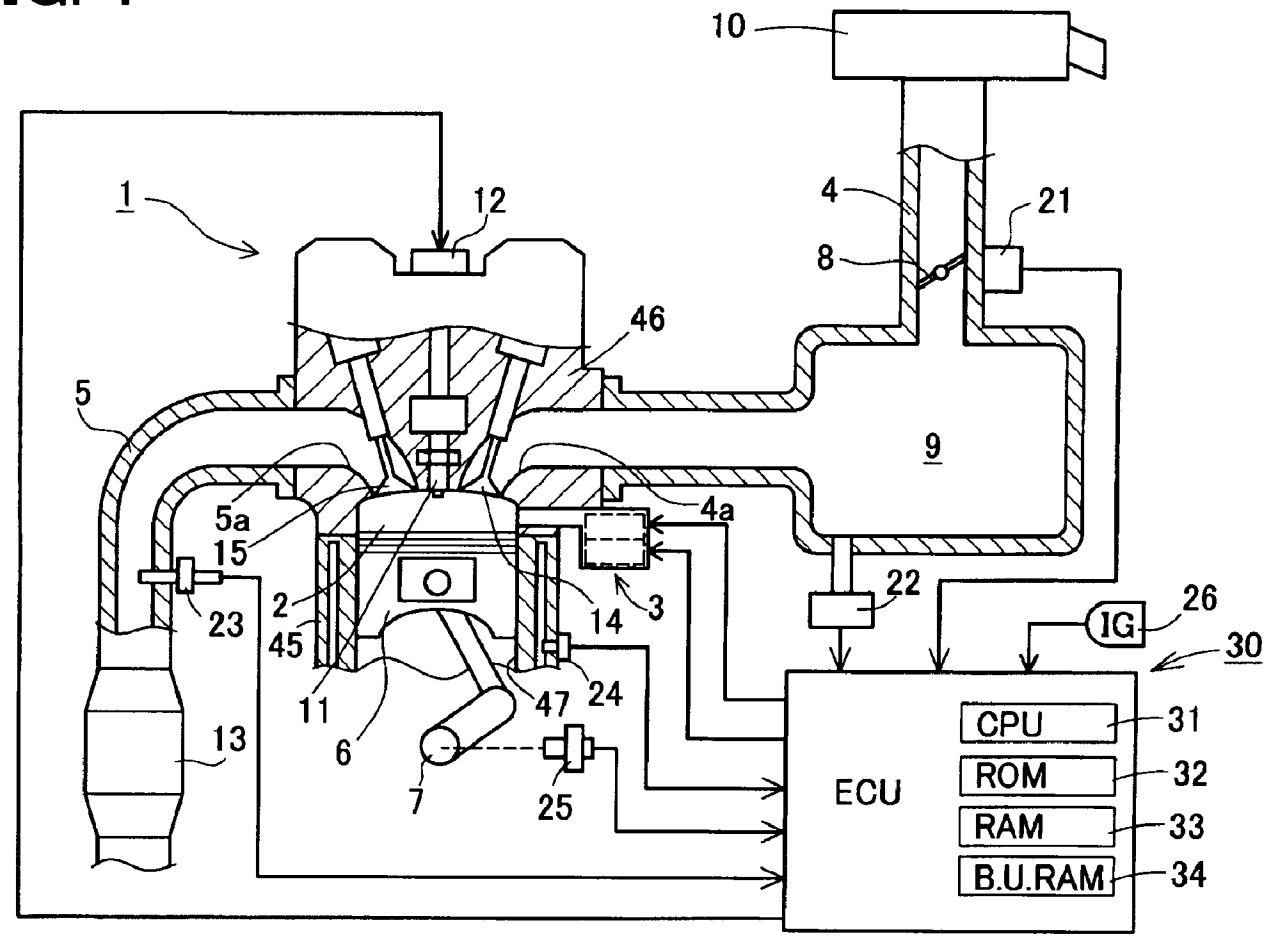
FIG. 1 is a schematic construction diagram showing a direct injection type engine system in a first embodiment.

FIG. 1 is a schematic construction diagram of a direct injection type internal combustion engine system (hereinafter referred to as the "direct injection type engine system") including a fuel injection control device for an internal combustion engine embodying the present invention. A direct injection type engine system mounted on an automobile includes a reciprocating multi-cylinder engine 1 of a known structure. A direct injection type fuel injection device (simply "fuel injection device" hereinafter) 3 is installed in each of combustion chambers 2 which are formed respectively in the cylinders of the engine 1. The fuel injection device 3 is constructed so as to inject fuel and air directly into the associated combustion chamber 2. In the engine 1, a combustible air-fuel mixture of the air introduced through an intake passage 4 and the fuel and air injected from the fuel injection device 3 is exploded and burned in the combustion chamber 2 in each cylinder and the exhaust gas after the combustion is discharged to the exterior through an exhaust passage 5, whereby a piston 6 is operated to rotate a crankshaft 7 and produce power.

A throttle valve 8 disposed in the intake passage 4 is opened and closed for adjusting the amount of air (intake quantity) Ga which is introduced into the combustion chamber 2 in each cylinder through the passage 4. The valve 8 operates in interlock with the operation of an accelerator pedal (not shown) provided in the driver's seat. A throttle sensor 21, which is provided correspondingly to the throttle valve 8, detects an opening degree (a throttle position, or angle) TA of the valve 8 and outputs an electric signal representing the detected value. Since the throttle valve 8 interlocks with the operation of the accelerator pedal, the operation of the accelerator pedal is reflected in the throttle position TA detected by the throttle sensor 21. A surge tank 9 is provided in the intake passage 4 and an intake pressure sensor 22 is attached to the surge tank 9. The intake pressure sensor 22 detects a pressure (intake pressure) PM of intake air in the intake passage 4 at a position downstream of the throttle valve 8 and outputs an electric signal representing the detected value.

Each fuel injection device 3 injects fuel and air directly into the corresponding combustion chamber 2. Each fuel injection device 3 is supplied with fuel and air at a predetermined pressure from a predetermined fuel supply unit and an air supply unit (neither shown). By operation of the fuel injection device 3, both fuel and air thus fed to each fuel injection device 3 are injected into the corresponding combustion chamber 2. Air is introduced into the intake passage 4 from the exterior through an air cleaner 10. The air thus introduced into the intake passage 4 is then introduced into the combustion chamber 2 in each cylinder, forming a combustible air-fuel mixture together with the fuel and air injected from each fuel injection device 3.

A spark plug 11 provided in the combustion chamber 2 of each cylinder performs an igniting operation upon receipt of an ignition signal provided from an ignition coil 12. The spark plug 11 and the ignition coil 12 constitute an ignition device for igniting the combustible air-fuel mixture formed in the combustion chamber 2.

A catalytic converter 13 placed in the exhaust passage 5 contains a three-way catalyst for purifying the exhaust gas discharged from the combustion chamber 2.

An oxygen sensor 23 disposed upstream of the catalytic converter 13 detects an oxygen concentration Ox in the exhaust gas which is discharged from the combustion chamber 2 to the exhaust passage 5 and outputs an electric signal representing the detected value.

A water temperature sensor 24 installed in the engine 1 detects the temperature (cooling water temperature) THW of cooling water flowing through the interior of the engine 1 and outputs an electric signal representing the detected value. A rotational speed sensor 25 installed in the engine 1 detects a rotational speed of the crankshaft 7 as an engine rotational speed (hereinafter, referred to as an "engine speed") NE and outputs an electric signal representing the detected value. The sensor 25 detects a change in rotational angle (crank angle) of the crankshaft 7 at every predetermined angle and outputs the detected value as a pulse signal. An ignition switch 26 installed in the driver's seat outputs a start signal when turned ON for starting the engine 1. The ignition switch 26 outputs a stop signal when turned OFF for stopping the engine 1.

In this embodiment, the throttle sensor 21, intake pressure sensor 22, oxygen sensor 23, water temperature sensor 24, and rotational speed sensor 25 correspond to an operating condition detecting means in the present invention which is for detecting an operating condition of the engine. In this embodiment, the intake quantity Ga is obtained by conversion from the values of intake pressure PM and engine speed NE which are detected by the intake pressure sensor 22 and the rotational speed sensor 25, respectively.

In this embodiment, an electronic control unit (ECU) 30 receives various signals from the throttle sensor 21, intake pressure sensor 22, oxygen sensor 23, water temperature sensor 24, rotational speed sensor 25, and ignition switch 26. In accordance with these input signals, the ECU 30 executes controls such as fuel injection control and ignition timing control to control the fuel injection device 3 and the ignition coil 12 respectively.

By the fuel injection control is meant to control each fuel injection device 3 in accordance with an operating condition of the engine 1, thereby controlling fuel injection quantity, fuel injection timing, and fuel spray. By the ignition timing control is meant to control the ignition coil 12 in accordance with an operating condition of the engine 1, thereby controlling the ignition timing in each spark plug 11.

As known well, the ECU 30 comprises a central processing unit (CPU) 31, a read-only memory (ROM) 32, a random access memory (RAM) 33, and a backup RAM (B.U. RAM) 34. In the ROM 32 are beforehand stored predetermined control programs associated with the foregoing various controls. In accordance with the stored control programs the ECU 30 (CPU 31) executes the foregoing various controls.

Figure 2:
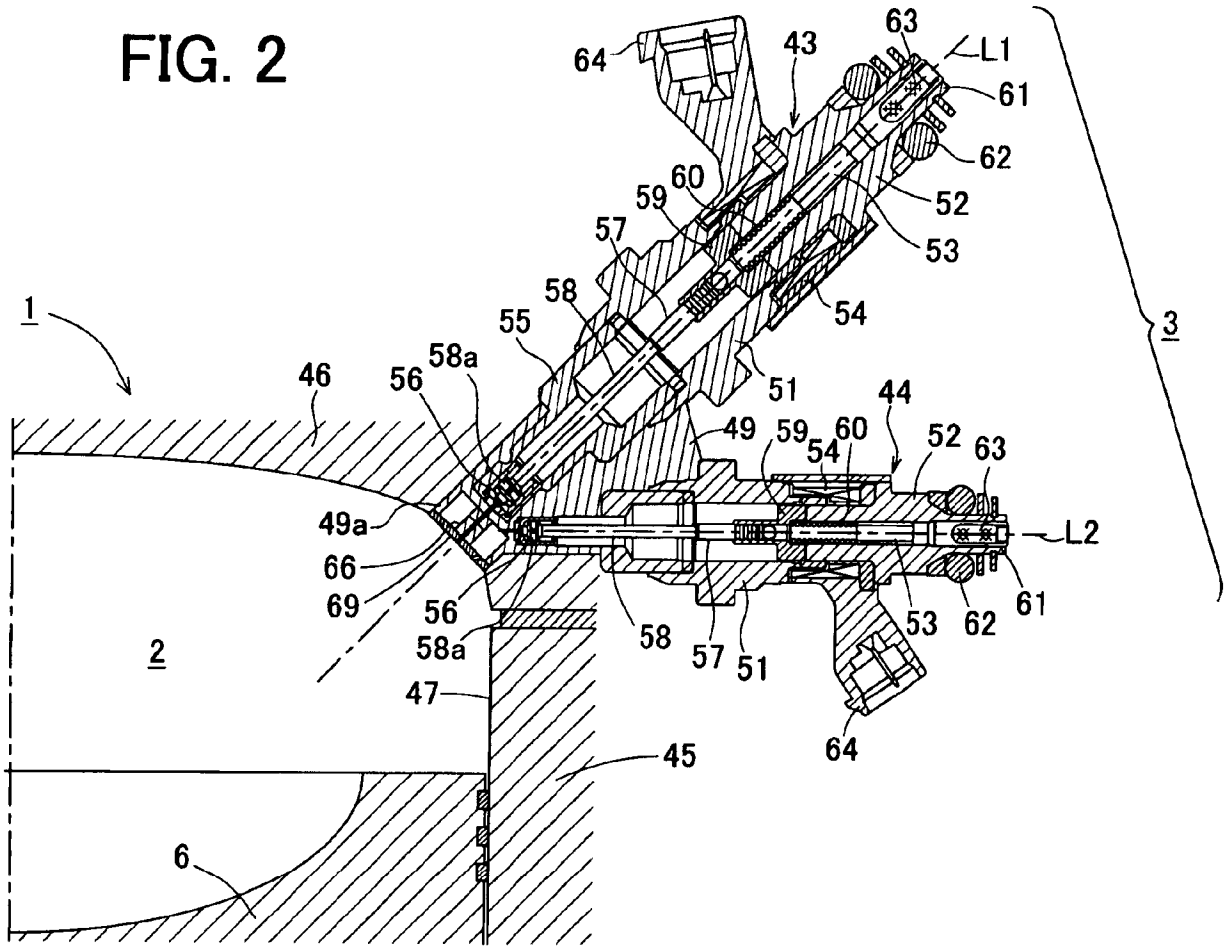
FIG. 2 is a sectional view showing a mounted state of a fuel injection device to the engine.

FIG. 2 is a sectional view showing in what state each fuel injection device 3 is mounted to the engine 1. This fuel injection device 3 corresponds to an air blast type fuel injection device constructing spray velocity changing means, spray particle diameter changing means, spray angle changing means, and injection timing changing means of the present invention. The fuel injection system 3 is provided with a fuel injection valve 43 for the injection of fuel into the corresponding combustion chamber 2 in the engine 1 and an air injection valve 44 as a gas injection valve for the injection of air as gas into the combustion chamber 2. The engine 1 includes a cylinder block 45 and a cylinder head 46. A piston 6 is provided for reciprocating motion in each of cylinder bores 47 formed in the cylinder block 45. Each combustion chamber 2 is constituted as a space enclosed with the corresponding cylinder bore 47, piston 6, and cylinder head 46. As shown in FIG. 1, intake ports 4*a* and exhaust ports 5*a* communicating with the combustion chambers 2 are formed in the cylinder head 46. An intake valve 14 of a known structure is mounted in each intake port 4*a*, while an exhaust valve 15 of a known structure is mounted in each exhaust port 5*a*. The fuel injection valve 43 and the air injection valve 44 are integrally mounted to the cylinder head 46 through a mounting member 49 correspondingly to the associated combustion chamber 2. Both valves 43 and 44 are secured to the mounting member 49 so that respective central axes L1 and L2 cross each other obliquely.

The fuel injection valve 43, which is constituted by a known electromagnetic valve, comprises a housing 51, a core 52 fitted in the housing 51, an adjusting pipe 53 disposed in the interior of the core 52, a solenoid 54 disposed between the housing 51 and the core 52, a lower body 55 disposed on a front end side of the housing 51, a nozzle body 56 disposed in the interior of the lower body 55, and a valve body 57 disposed between the nozzle body 56 and the core 52. The valve body 57 is provided with a valve stem 58 having a valve portion 58*a* at a front end thereof and an armature 59 mounted to a base end thereof. A compression spring 60 is disposed between the armature 59 and the adjusting pipe 53. A base end portion of the core 52 is formed as a pipe connector 61 connected to a fuel pipe (not shown). An O-ring 62 is fitted on an outer periphery of the pipe connector 61. A strainer 63 for the removal of foreign matters is disposed in the interior of the pipe connector 61. A wiring connector 64 connected to an electric wiring is formed on the housing 51. The fuel injection valve 43 and the air injection valve 44 have substantially the same basic construction and therefore the components of the air injection valve 44 are identified by the same reference numerals as those of the fuel injection valve 43 and explanations thereof will be omitted.

Figure 3:
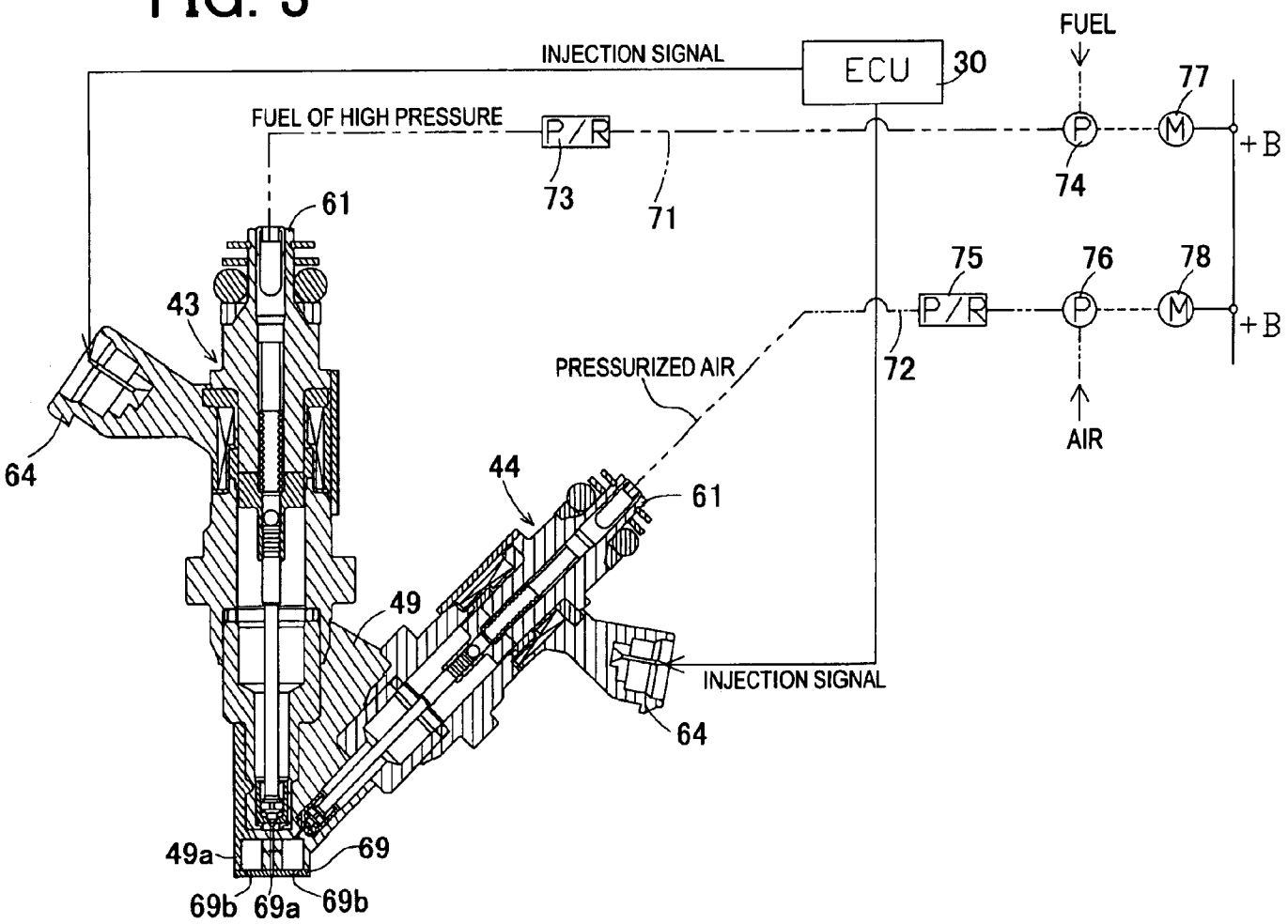
FIG. 3 is a conceptual construction diagram showing an electric wiring, etc. for a fuel injection valve and an air injection valve.

FIG. 3 is a conceptual construction diagram showing electric wiring and fuel and air piping associated with the fuel injection valve 43 and the air injection valve 44. As shown in the same figure, a fuel pipe 71 is connected to the pipe connector 61 in the fuel injection valve 43, while an air pipe 72 is connected to the pipe connector 61 in the air injection valve 44. A pressure regulator 73 and a fuel pump 74 are installed in the fuel pipe 71, while a pressure regulator 75 and an air pump 76 are installed in the air pipe 72. The pumps 74 and 76 are actuated by corresponding motors 77 and 78, respectively. When the fuel pump 74 is actuated, fuel stored in a fuel tank (not shown) is discharged from the pump 74 and is fed as a constant high-pressurized fuel to the fuel injection valve 43 though the pressure regulator 73. Likewise, when the air pump 76 is actuated, air is discharged from the pump 76 and is fed as pressurized air to the air injection valve 44 through the pressure regulator 75.

As shown in FIG. 3, the wiring connector 64 in the fuel injection valve 43 and the wiring connector 64 in the air injection valve 44 are electrically connected to the ECU 30. The fuel injection valve 43 and the air injection valve 44 operate in accordance with injection signals provided from the ECU 30. When the fuel injection valve 43 operates in accordance with an injection signal provided from the ECU 30, a high-pressurized fuel is injected from the injection valve 43. Likewise, when the air injection valve 34 operates in accordance with an injection signal provided from the ECU 30, pressurized air is injected from the injection valve 44. In this embodiment, the ECU 30 corresponds to a control means in the present invention for controlling the fuel injection valve 43 and the air injection valve 44 each independently.

Figure 4:
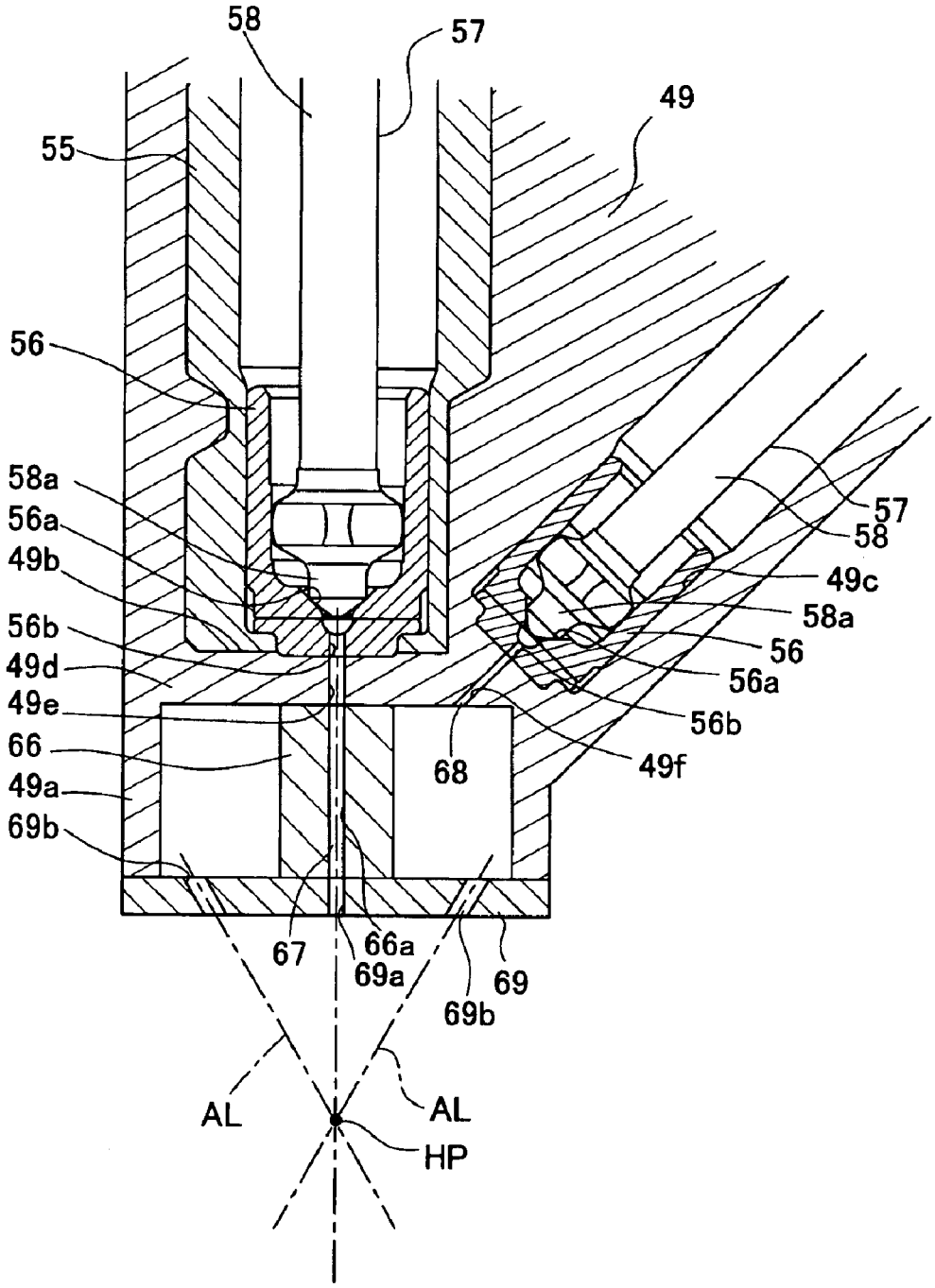
FIG. 4 an enlarged sectional view showing a tip portion of a mounting member.

FIG. 4 is an enlarged sectional view of a tip portion of the mounting member 49. As shown in FIGS. 2 to 4, the mounting member 49, which is like a block, comprises a cylindrical portion 49*a* which faces the corresponding combustion chamber 2, a first mounting hole 49*b* into which the lower body 55 of the fuel injection valve 43 is fitted, and a second mounting hole 49*c* into which the nozzle body 56 of the air injection valve 44 is fitted. The cylindrical portion 49*a* and the first mounting hole 49*b* are disposed in alignment with each other and are partitioned from each other by a partition wall 49*d*. A hole 49*e* is formed centrally in the partition wall 49*d*. A tube 66 having a hole 66*a* is provided at the center of the cylindrical portion 49*a*. The nozzle body 56 fitted in the first mounting hole 49*b* is formed with a valve seat 56*a* corresponding to the valve portion 58*a*. A valve hole 56*b* formed in the valve seat 56*a* is aligned with the two holes 49*e* and 66*a* to constitute a single fuel passage 67. In the mounting member 49 is formed a hole 49*f* which extends from the center of the second mounting hole 49*c* toward the inside of the cylindrical portion 49*a*. The hole 49*f* is positioned so as to intersect the center of the cylindrical portion 49*a* obliquely. A valve seat 56*a* corresponding to the valve portion 58*a* is formed in the nozzle body 56 fitted in the second mounting hole 49*c*. A valve hole 56*b* formed in the valve seat 56*a* is aligned with the oblique hole 49*f* to constitute a single air passage 68. An orifice plate 69 is fixed to an open end of the cylindrical portion 49*a*. At the center of the orifice plate 69 is formed a single fuel injection orifice 69*a* correspondingly to the fuel injection valve 43. The fuel injection orifice 69*a* opens into the combustion chamber 2 and is aligned with the fuel passage 67. In the orifice plate 69 there are formed plural air injection orifices 69*b* as gas injection orifices correspondingly to the air injection valve 44. The air injection orifices 69*b* are positioned in the vicinity of the fuel injection orifice 69*a* and open into the combustion chamber 2 and communicate with the inside of the cylindrical portion 49*a*. Consequently, a high-pressurized fuel injected from the fuel injection valve 43 passes through the fuel passage 67 and is injected into the combustion chamber 2 from the fuel injection orifice 69*a* formed in the orifice plate 69. On the other hand, pressurized air injected from the air injection valve 44 passes through the fuel passage 68 and is once injected into the cylindrical portion 49*a*, then is injected into the combustion chamber 2 from the air injection orifices 69*b* formed in the orifice plate 69.

Figure 5:
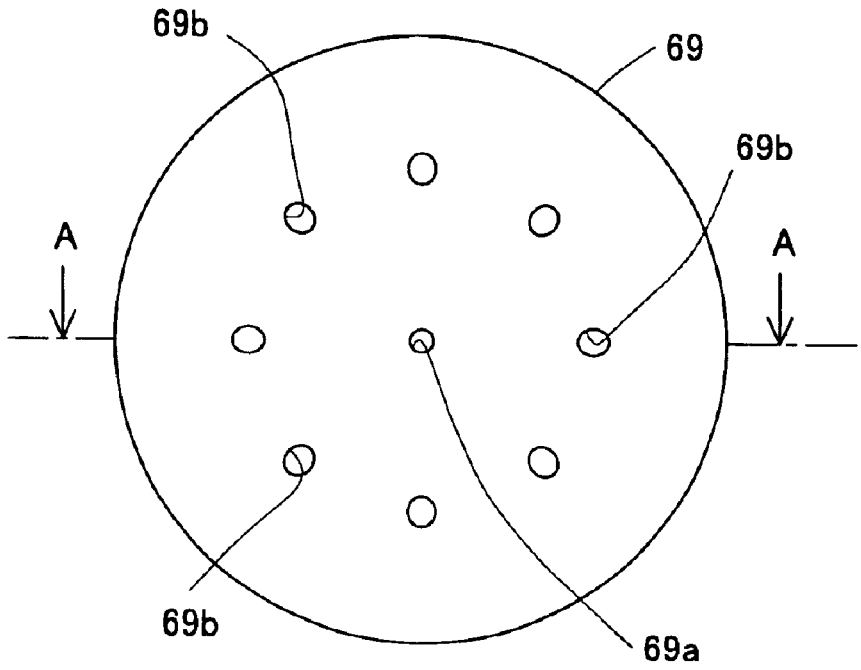
FIG. 5 is a plan view showing an orifice plate.
Figure 6:
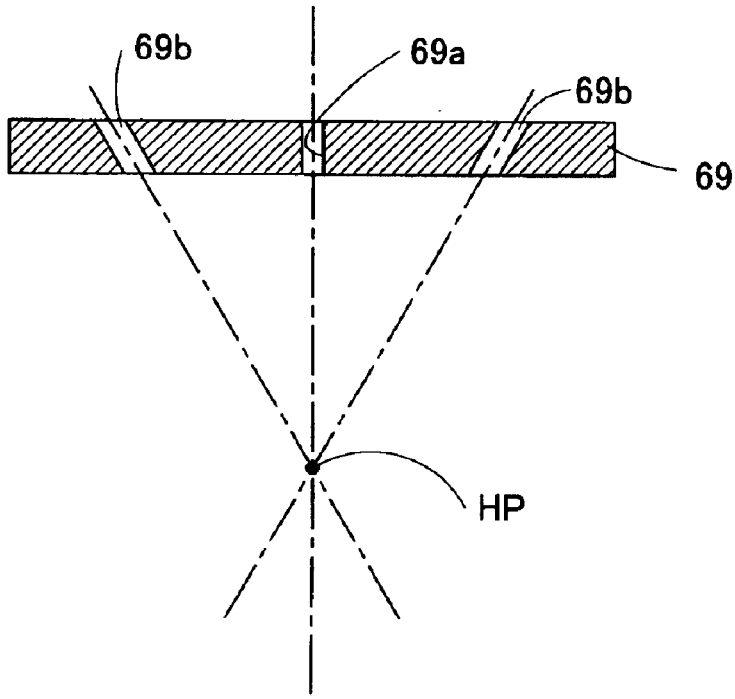
FIG. 6 is a sectional view taken on line A—A in FIG. 5.

FIG. 5 is a plan view of the orifice plate 69 and FIG. 6 is a sectional view taken on line A—A in FIG. 5. As shown in FIGS. 5 and 6, the fuel injection orifice 69*a* is circular in section and is formed perpendicularly through an end face of the orifice plate 69. The plural air injection orifices 69*b* are also circular in section (elliptic at their open ends) and are formed obliquely through the end face of the orifice plate 69. As shown in FIG. 5, the plural (eight in the illustrated example) air injection orifices 69*b* are arranged at equal angle intervals on a circumference centered on the fuel injection orifice 69*a*. In this embodiment, the inside diameter of the fuel injection orifice 69*a* is set at 0.6 mm and that of each air injection orifice 69*b* is set at 1.0 mm.

As shown in FIG. 6, the fuel injection orifice 69*a* and the air injection orifice 69*b* are formed in such a manner that a central line of the fuel injection orifice 69*a* and that of each air injection orifice 69*b* cross each other at one point ("collision point" hereinafter) HP. Fuel is injected from the fuel injection orifice 69*a* toward the collision point HP, whereby there is formed a fuel spray. Likewise, air is injected from the air injection orifices 69*b* toward the collision pint HP, whereby there is formed an air jet. Thus, the fuel spray and the air jets collide with each other, centered on the collision point HP. In this embodiment, as described above, the directions of the air injection orifices 69*b* and the fuel injection orifice 69*a* are set so that the air jets from the air injection orifices 69*b* come into collision with the fuel spray injected from the fuel injection orifice 69*a*.

Figure 7A:
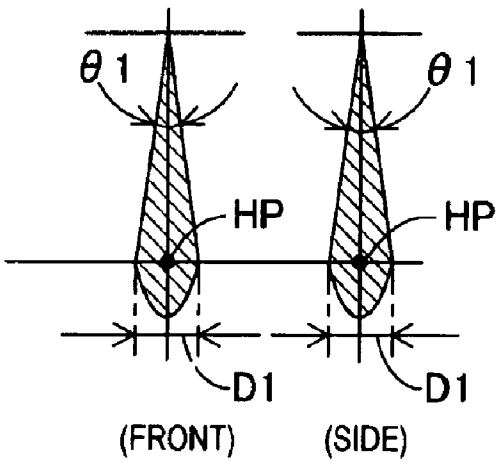
FIGS. 7A to 7C are conceptual diagrams each showing a fuel spray and an air jet.
Figure 7B:
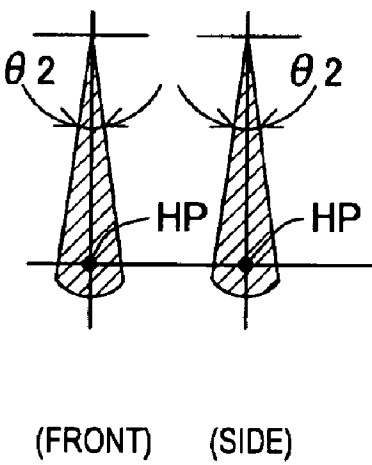
Figure 7C:
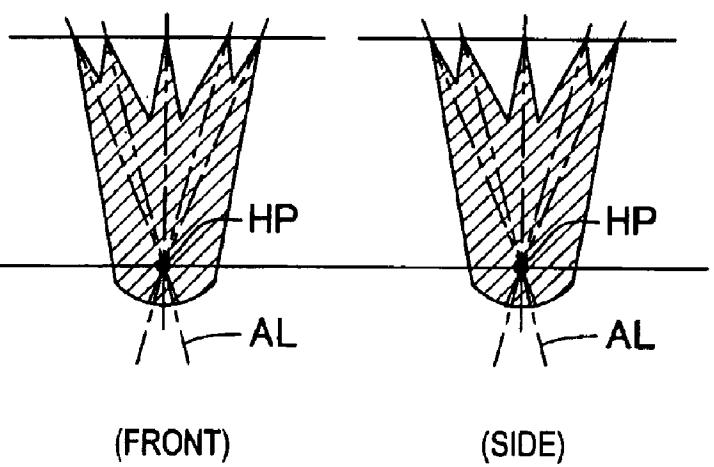
Figure 8:
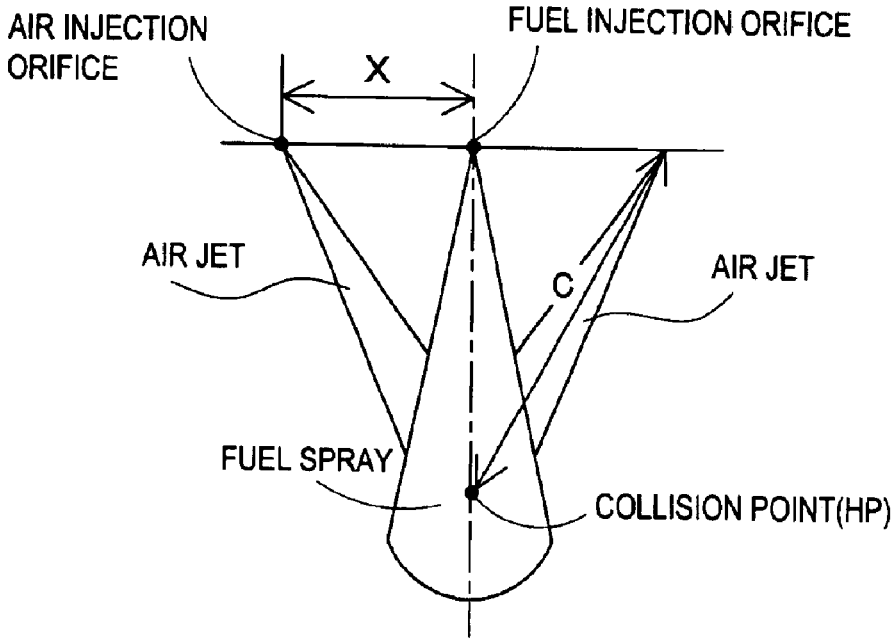
FIG. 8 is a conceptual diagram showing collision between a fuel spray and air jets at a collision point.
Figure 9:
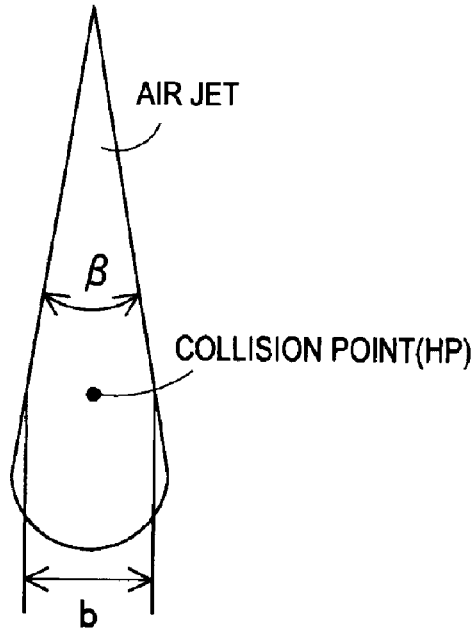
FIG. 9 is a conceptual diagram showing an air jet.

FIGS. 7A to 7C are conceptual diagrams of a fuel spray and an air jet(s). As shown in FIG. 7A, a fuel spray is generally conical in both front and side view. A spread angle (spray angle) θ1 of the fuel spray is determined by the size of inside diameter of the fuel injection orifice 69*a* formed in the orifice plate 69. As shown in FIG. 7B, one air jet (free jet) is generally conical in both front and side view. A spread angle (jet angle) θ2 of the air jet is determined, for example, by the size of inside diameter of each air injection orifice 69*b* formed in the orifice plate 69. As shown in FIG. 7C, peripheral air jets (multi-orifice jets) from the plural air injection orifices 69*b* are generally crown-shaped in both front and side view. In general, the energy of a gas jet becomes smaller with separation from a gas injection orifice. Therefore, the collision point HP in fuel spray is set at a position at which there is maintained a distance from each air injection orifice 69*b* to the extent that the energy of each air jet interferes with the fuel spray and permits adjustment of the fuel spray penetration distance (hereinafter, "spray penetration distance"), the fuel spray velocity (hereinafter, "spray velocity"), the fuel spray particle diameter (hereinafter, "spray particle diameter"), the fuel spray angle (hereinafter, "spray angle"), and the fuel spray shape (hereinafter, "spray shape"). The size (outside diameter (width)) at the collision point HP of each air jet injected from each air injection hole 69*b* is set so as to become almost equal to an outside diameter D1 at the collision point HP of the fuel spray injected from the fuel injection orifice 69*a*. "The size of each air jet" which becomes almost equal to the outside diameter D1 of the fuel spray is defined from "jet angle β" and "air jet outside diameter, b" of an air jet shown in FIG. 9, "distance, c" from an air injection orifice to the collision point HP shown in FIG. 8, and a predetermined expression "b=2*c*tan(β/2)."

Figure 10A:
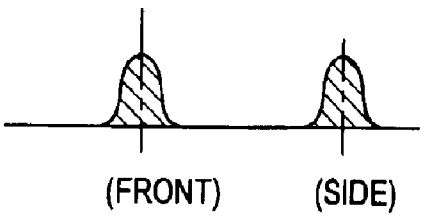
FIGS. 10A to 10C are conceptual diagrams each showing a difference between a spray strength and a jet strength at a collision point.
Figure 10B:
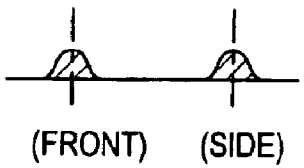
Figure 10C:
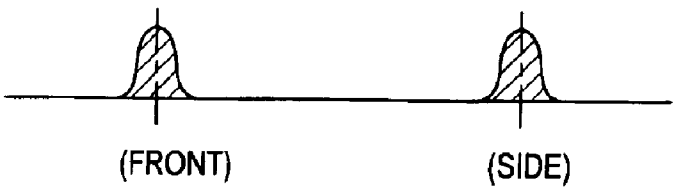

FIGS. 10A to 10C are conceptual diagrams showing a difference between a fuel spray strength (spray strength) and an air jet strength (jet strength) at the collision point HP. As shown in FIG. 10A, a fuel spray exhibits a spray strength having the same distribution width in both front and side views. As shown in FIG. 10B, one air jet (free jet) exhibits a jet strength having the same distribution width in both front and side view. This jet strength is a little lower than the spray strength. As shown in FIG. 10C, a jet strength based on plural air jets (multi-orifice jets) has the same distribution width in both front and side view. The jet strength of the multi-orifice jets is higher than that of one air jet. Thus there is made design so that the air jet strength distribution is uniformly superimposed on the fuel spray strength distribution. The spray strength and the jet strength can be calculated from the product of flow velocity and density.

According to the fuel injection device 3 of this embodiment thus constructed, fuel from one fuel injection valve 43 is injected into the combustion chamber 2 through one corresponding fuel injection orifice 69*a*, whereby there is formed a fuel spray within the combustion chamber 2. The form of the fuel spray is determined upon specifying of shape, size, and direction of the fuel injection orifice 69*a*. On the other hand, air from one air injection valve 44 is injected into the combustion chamber 2 through corresponding plural air injection orifices 69*b*, whereby there are formed air jets within the combustion chamber 2. The form of the air jets and the influence thereof on the fuel spray are determined upon specifying of the number, shape, size, and direction of each air injection orifice 69*b*, as well as the arrangement thereof with respect to the fuel injection orifice.

Air jet axes AL (see FIG. 4) extending from the air injection orifices 69*b* are set so as to cross each other at the center of a maximum diameter D1 (see FIG. 7A) in the fuel spray injected from the fuel injection orifice 69*a*. Therefore, according to the form of the fuel spray, each air jet collides with the whole of the fuel spray, centered at the collision point HP, so that the strength distributions of air jets relative to the fuel spray become equal. As a result, it is possible to attain uniform and finer fuel atomization in the whole of the fuel spray and hence possible to promote the atomization of fuel. Consequently, it is possible to improve the combustion performance of the direct injection type engine 1.

Particularly, in this embodiment, since the fuel injection orifice 69*a* formed in the orifice plate 69 is circular, the fuel spray becomes conical and the spray angle θ1 (see FIG. 7A) of the fuel spray is determined by the size of inside diameter of the fuel injection orifice 69*a*. Further, since each air injection orifice 69*b* formed in the orifice plate 69 is circular, each air jet becomes conical and the jet angle θ2 thereof (see FIG. 7B) are determined by, for example, the size of inside diameter of each air injection orifice 69*b*. Plural air injection orifices 69*b* are arranged at equal angle intervals on a circumference centered at the fuel injection orifice 69*a* and, as shown in FIG. 7C, plural air jets from the air injection orifices 69*b* are inclined toward one collision point HP. Thus, plural air jets collide with the peripheral portion of the conical fuel spray and the strength distributions of the air jets relative to the fuel spray become equal. Consequently, according to the shape of the fuel spray, air jets can be brought into collision with the fuel spray uniformly throughout the whole in the width direction of the fuel spray. Particularly, for a conical fuel spray, it is possible to attain uniform and finer fuel atomization in the whole of the fuel spray without greatly changing the spray shape and hence possible to promote the atomization of fuel.

In this embodiment, each air injection orifice 69*b* is disposed in the vicinity of the fuel injection orifice 69*a*. For adjusting the fuel spray penetration distance and the spray shape with use of air jets, it is necessary that, at the collision point HP between the fuel spray and the air jets, the energy of the air jets interfere with the fuel spray and be maintained to such an extent as permits adjustment of the spray penetration distance, spray velocity, spray particle diameter, spray angle, and spray shape. The energy of each air jet becomes smaller with separation from each air injection orifice 69*b*. Therefore, when each air injection orifice 69*b* is disposed in the vicinity of the fuel injection orifice 69*a*, the collision point HP between each air jet and the fuel spray is set in the vicinity of the fuel injection orifice 69*a*. As a result, it becomes possible to adjust the spray penetration distance, spray velocity, spray particle diameter, spray angle, and spray shape.

In the present embodiment, the "spray penetration distance" indicates a vertical distance (in an injecting direction) from the fuel injection orifice 69*a* to a travel end of a fuel spray in a predetermined elapsed time after fuel injection start. In the case of supposing that a contrast in a photograph of a fuel spray, which is photographed from front under lighting from both sides by a flash lamp, between a region (white) where the fuel spray exists and a region (black) where the fuel spray does not exist is "1", the above "travel end of a fuel spray" indicates a spray boundary with a contrast in a range of "0.5 (reference)±0.2". The "spray velocity" indicates a value derived from time-differentiation of the spray penetration distance or an increasing rate of the spray penetration distance in the case where the spray penetration distance is determined with use of the same threshold value (not limited to the above range) of the spray travel end.

In this embodiment, it is designed that an air jet to be injected from each air injection orifice 69*b* is almost equal in size to a fuel spray to be injected from the fuel injection orifice 69*a*. Therefore, air jets come into collision with the whole of the fuel spray correspondingly to the form of the fuel spray and it becomes possible to adjust the whole fuel spray in relation to the fuel penetration distance, spray velocity, spray particle diameter, spray angle, and spray shape. Thus, by making an air jet of about the same size as a fuel spray collide with the fuel spray, it is possible to atomize the fuel more finely in the whole of the fuel spray.

In this embodiment, since the fuel injection orifice 69*a* and the air injection orifices 69*b* are both circular in section, the injection orifices 69*a* and 69*b* can be formed relatively easily by punching with use of a punch or the like. Therefore, the orifice plate 69 can be fabricated relatively easily. Moreover, by merely changing pressure and the shape (e.g., "taper") of each air injection orifice 69*b*, the jet angle θ2 of each air jet (see FIG. 7B) is changed and the air jet strength distribution is adjusted. Further, by merely changing the inside diameter of the circular fuel injection orifice 69*a*, the spray angle θ1 of the fuel spray (see FIG. 7A) is changed and the fuel spray strength distribution is adjusted. Consequently, a particle size level for atomization can be set arbitrarily in a relatively easy manner. Additionally, by adjusting the spray angle θ1 and jet angle θ2 and adjusting the direction of fuel spray and that of air spray, it is possible to set a desired spray penetration distance, a spray velocity, and a desired spray shape relatively easily.

Figure 11:
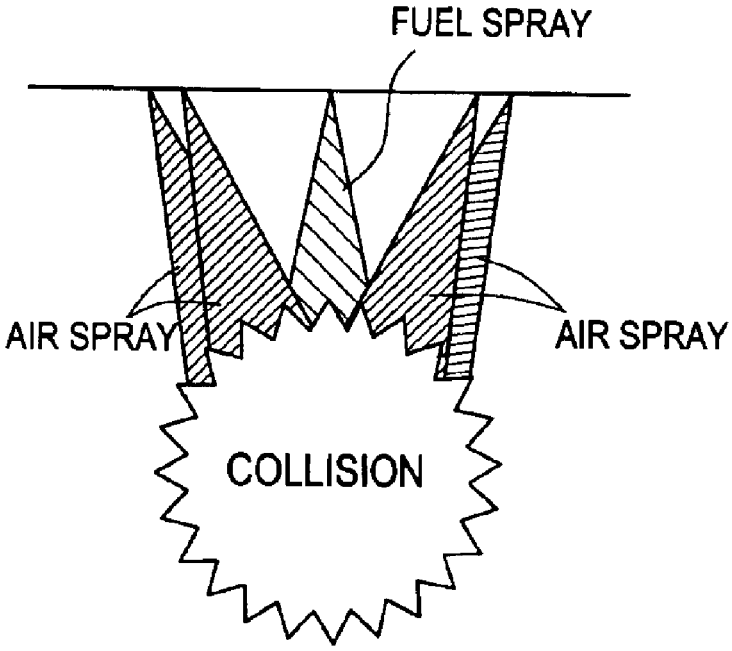
FIG. 11 is a conceptual diagram showing a state of collision of air jets with a fuel spray.

FIG. 11 is a conceptual diagram showing a state of collision of plural air jets with a fuel spray. In this embodiment, as shown in FIGS. 7A to 7C, plural air jets having the same size and strength distribution are collided with one fuel spray, so even if the strength distribution of the fuel spray itself is not uniform, it is possible to let the influence of air jets be exerted uniformly on the whole of the spray. As a result, it is possible to atomize the fuel appropriately and hence possible to set an appropriate spray penetration distance, a spray velocity, etc.

In this embodiment, the fuel injection valve 43 and the air injection valve 44 are integrally mounted to the cylinder head 46 through the mounting member 49 correspondingly to the combustion chamber 2. Therefore, in comparison with the case where the injection valves 43 and 44 are mounted each independently, the positional accuracy of the air injection orifices 69*b* relative to the fuel injection orifice 69*a* becomes higher and mounting works, including machining, for the cylinder head 46 decrease. If the fuel injection valve 43 and the air injection valve 44 are assembled beforehand to the mounting member 49, all that is required is a mere mounting of the mounting member 49 to the cylinder head 46, whereby the injection valves 43 and 44 are also mounted to the cylinder head 46 simultaneously. Consequently, it is possible to simplify the manufacture of the fuel injection device.

Figure 12:
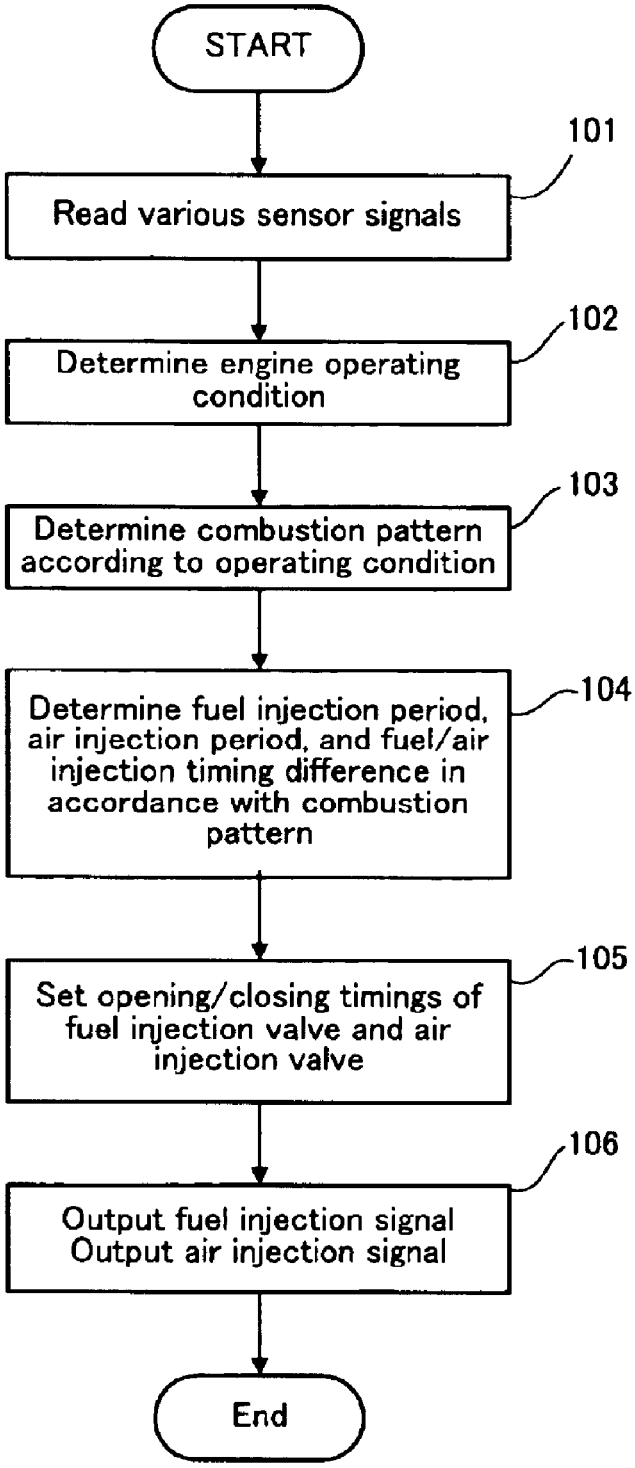
FIG. 12 is a flow chart showing a fuel injection control routine.

Next, a description will be given below about the details of a fuel injection control processing which the ECU 30 executes for making the fuel spray penetration distance, spray velocity, spray particle diameter, spray angle, and spray shape variable. FIG. 12 shows an associated "fuel injection control routine" in terms of a flow chart. The ECU 30 executes this routine periodically at every predetermined time during operation of the engine 1.

First, in step 101, the ECU 30 reads detected signals provided from the throttle sensor 21, intake pressure sensor 22, oxygen sensor 23, water temperature sensor 24, and rotational speed sensor 25.

In step 102, the ECU 30 determines an operating condition of the engine 1 on the basis of the detected signals thus inputted. In this embodiment, the ECU 30 determines an operating condition out of conditions including "low temperature starting operation," "partial load operation," and "full load operation." For example, when the cooling water temperature THW and the engine speed NE are relatively low and the throttle angle TA is relatively small, the ECU 30 determines that the engine operation is a "low temperature starting operation." When the cooling water temperature THW and the engine speed NE are somewhat high and there is a slight change in the throttle angle TA, the ECU 30 determines that the engine operation is a "partial load operation." Further, when the cooling water temperature THW and the engine speed NE are somewhat high and the throttle angle TA changes to full open, the ECU 30 determines that the engine operation is a "full load operation."

In step 103, the ECU 30 determines an optimal combustion pattern corresponding to the operating condition thus determined. In this embodiment, combustion patterns suitable for various operating conditions are confirmed and established experimentally in advance. FIG. 13 tabulates relations between operating conditions and combustion patterns. As is seen from the table of FIG. 13, when the engine operation is a "low temperature starting operation," "warm-up combustion" is determined as a combustion pattern. Likewise, in the case of a "partial load operation," "stratified charge combustion" is determined as a combustion pattern. Further, in the case of a "full load operation," "uniform combustion" is determined as a combustion pattern.

In step 104, in accordance with the combustion pattern thus determined, the ECU 30 determines "fuel injection period," "air injection period," and "fuel/air injection timing difference" in the injection by the fuel injection valve 43 and the air injection valve 44. For example, in the case of "warm-up combustion," as shown in FIG. 13, "Fuel/air injection periods" are determined to be "same period" and "Fuel/air injection timing difference" is determined to be "same timing." In case of "stratified charge combustion," as shown in FIG. 13, "Fuel/air injection periods" are determined such that "Air injection period is long" and "Fuel/air injection timing difference" is determined such that "Air injection timing precedes." Further, in the case of "uniform combustion," as shown in FIG. 13, "Fuel/air injection periods" are determined such that "Air injection period is somewhat long." and "Fuel/air injection timing difference" is determined such that "Air injection timing somewhat precedes."

In step 105, on the basis of the thus-determined "fuel/air injection periods" and "fuel/air injection timing difference," the ECU 30 establishes opening/closing timings of the fuel injection valve 43 and the air injection valve 44 corresponding to a change in crank angle. For example, in the case of "warm-up combustion," as shown in FIGS. 14A and 14B, an opening timing of the fuel injection valve 43 and that of the air injection valve 44 are similarly set in the range from angle a0 to angle a3. In the case of "stratified charge combustion," as shown in FIGS. 15A and 15B, an opening timing of the fuel injection valve 43 is set in the range from angle a2 to angle a3, while an opening timing of the air injection valve 44 is set in the range from angle a0 which precedes the angle a2 of the fuel injection valve 43 by an angle difference of ΔA to angle a3 as in the case of the fuel injection valve 43. Further, in the case of "uniform combustion," as shown in FIGS. 16A and 16B, an opening timing of the fuel injection valve 43 is set in the range from angle a2 to angle a3, while an opening timing of the air injection valve 44 is set in the range from angle a1 which somewhat precedes the angle a2 of the fuel injection valve 43 by an angle difference of ΔB (ΔB<ΔA) to angle a3 as in the case of the fuel injection valve 43.

Then, in step 106, the ECU 30 outputs a fuel injection signal and an air injection signal corresponding to the thus-set opening and closing timings to the fuel injection valve 43 and the air injection valve 44, respectively.

Controlling the opening/closing timings of the fuel injection valve 43 and the air injection valve 44 as above is for controlling the fuel spray penetration distance, spray velocity, spray particle diameter, spray angle, and spray shape in the injection of fuel by the fuel injection device 3. That is, for controlling the fuel spray penetration distance, spray velocity, spray particle diameter, spray angle, and spray shape, the ECU 30 sets the fuel injection timing and fuel injection period in fuel injection performed by the fuel injection valve 43 to constant values correspondingly to a change in crank angle and then controls both air injection timing and air injection period in the injection of air performed by the air injection valve 44 on the basis of an operating condition determined for the engine 1. More specifically, for attaining "warm-up combustion," the ECU 30 equalizes the timing of air injection performed by the air injection valve 44 to the timing of fuel injection performed by the fuel injection valve 43 and at the same time equalizes the period of air injection performed by the air injection valve 44 to the period of fuel injection performed by the fuel injection valve 43. Further, for attaining "stratified charge combustion" and "uniform combustion," the ECU 30 makes the timing of air injection performed by the air injection valve 44 precede or somewhat precede the timing of fuel injection performed by the fuel injection valve 43 and makes the period of air injection performed by the air injection valve 44 longer than the period of fuel injection performed by the fuel injection valve 43 by an angle difference ΔA or ΔB based on the crank angle.

Figure 17:
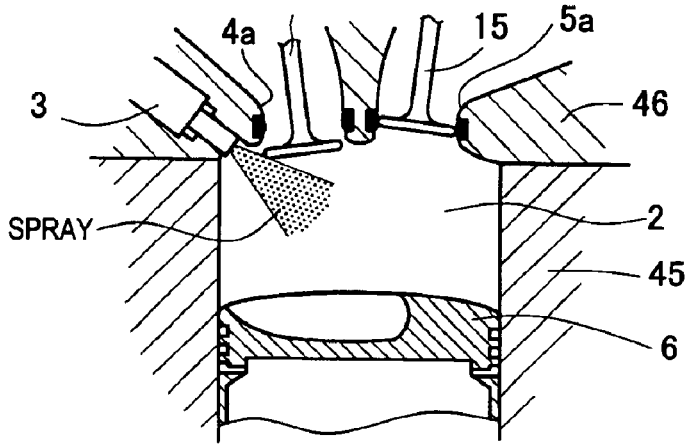
FIG. 17 is an image diagram showing spray characteristics in warm-up combustion.

According to the above fuel injection control, as shown in FIG. 13, in "warm-up combustion," the fuel/air injection periods are set to "same period" and the injection timing difference to "same timing." With this arrangement, there are obtained spray characteristics such that the spray penetration distance is short, the spray velocity is relatively low at the time of collision with a wall surface of the combustion chamber 2, the spray particle diameter is relatively small, and the spray shape has a large spray angle. FIG. 17 is an image diagram of the spray characteristics in question. In a low temperature starting operation of the engine 1, in order to prevent the adhesion of fuel to the crown of the piston 6, it is desirable that the spray penetration distance be set relatively short, the spray particle diameter for promoting the evaporation of fuel be set relatively small, and the spray shape for dispersing fuel throughout the whole of the combustion chamber 2 be set large in spray angle. Thus, the above spray characteristics for "warm-up combustion" become suitable for a low temperature starting operation of the engine 1.

Figure 18:
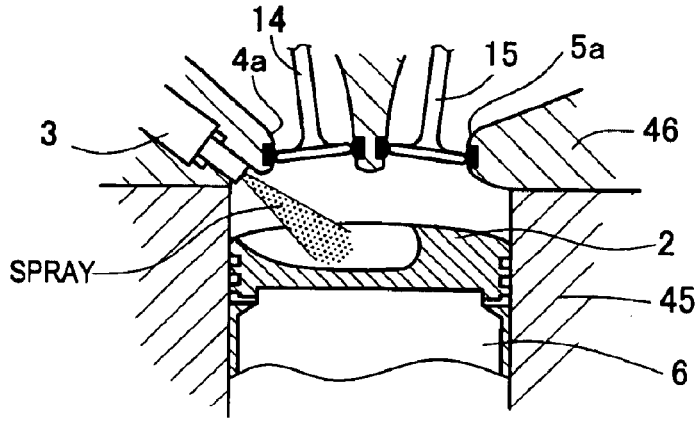
FIG. 18 is an image diagram showing spray characteristics in stratified charge combustion.

On the other hand, in "stratified charge combustion," as shown in FIG. 13, the fuel/air injection periods are set such that "Air injection period is somewhat long." and the injection timing difference is set such that "Air injection timing precedes." With this arrangement, there are obtained spray characteristics such that the spray penetration distance is relatively long, the spray velocity at the time of collision with the wall surface is relatively high, the spray particle diameter is relatively small, and the spray shape is small in spray angle. In other words, the ECU 30 controls an air blast type fuel injection device 3 so that the spray velocity be relatively high, the spray particle diameter be relatively small, and the spray angle be relatively small. The ECU 30 also controls the air blast type fuel injection device 3 to control the spray velocity, spray particle diameter, and spray angle as well as the fuel injection timing so that the fuel spray collides relatively highly with the crown of the piston 6 and the inner wall of the cylinder bore 47. FIG. 18 is an image diagram of the spray characteristics in question. In a partial load operation of the engine 1, a strong (long penetration distance) spray is required so that a stable air-fuel mixture can be collected around the spark plug at every cycle without being influenced by such a disturbance as air flow variation in the combustion chamber 2. Moreover, with heat from the piston 6, it is not required to attain such a high atomization as in a low temperature starting operation, but in order to make the formation of a stable air-fuel mixture it is desired to form spray particles smaller in diameter than in the present state. Further, it is required to obtain a spray shape having a small spray angle suitable for the stratification of spray. Consequently, the above spray characteristics for "stratified charge combustion" are suitable for a partial load operation of the engine 1.

Figure 19:
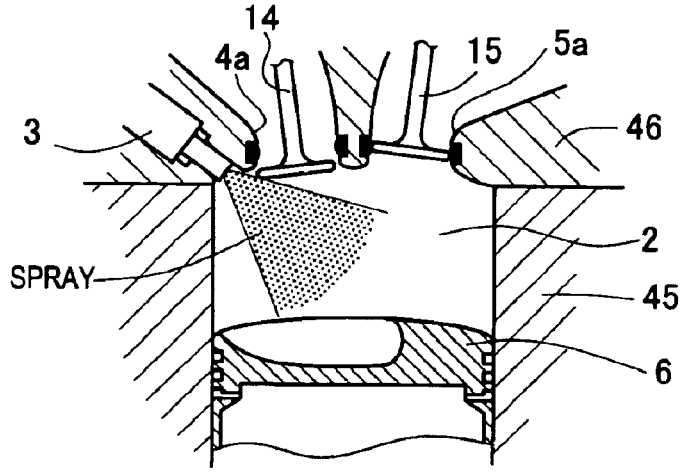
FIG. 19 is an image diagram showing spray characteristics in uniform combustion.

On the other hand, in "uniform combustion," as shown in FIG. 13, the fuel/air injection periods are set such that "Air injection period is a little long." and the injection timing difference is set such that "Air injection timing somewhat precedes." With this arrangement, there are obtained spray characteristics such that the spray penetration distance is relatively medium or so, the spray velocity is relatively medium at the time of collision with the wall surface, the spray particle diameter is relatively small, and the spray shape is medium in spray angle. More specifically, the ECU 30 controls the air blast type fuel injection device 3 so that, in the case of "uniform combustion", the spray velocity is relatively medium, the spray particle diameter is relatively small, and the spray angle is relatively medium. The ECU 30 also controls the air blast type fuel injection device 3 in order to control the spray velocity, spray particle diameter, and spray angle as well as the fuel injection timing to such an extent as making the fuel spray collide relatively weakly with the crown of the piston 6 and the inner wall of the bore 47. FIG. 19 is an image diagram showing the spray characteristics in question. In a full load operation of the engine 1, heat from the wall surface of the combustion chamber 2 can be expected despite of equal conditions to those in a low temperature starting operation. Therefore, it is required that the spray penetration distance be longer than that in a low temperature starting operation and shorter than that in a partial load operation. Moreover, for forming a stable air-fuel mixture, it is required that the spray particle diameter be made smaller than in the present state. Further, it is required that the spray angle be made smaller than that in a low temperature starting operation and larger than that in a partial load operation. Thus, the spray characteristics for "uniform combustion" are suitable for a full load operation of the engine 1.

According to the fuel injection control device of this embodiment described above, fuel is injected from the fuel injection orifice 69*a* in the fuel injection device 3 into the combustion chamber 2 to form a fuel spray in the combustion chamber 2. On the other hand, air is injected from the air injection orifices 69*b* in the fuel injection device 3 into the combustion chamber 2 to form air jets in the combustion chamber 2. In this construction, the air injection orifices 69*b* and the fuel injection orifice 69*a* are oriented such that the air jets injected from the air injection orifices 69*b* collide with the fuel spray injected from the fuel injection orifice 69*a*. Therefore, the shape of the fuel spray is changed upon collision of the air jets with the fuel spray.

For controlling the spray penetration distance, spray velocity, spray particle diameter, spray angle, and spray shape of the fuel spray injected from the fuel injection orifice 69*a*, the ECU 30 controls the fuel injection valve 43 and the air injection valve 44 each independently on the basis of an operating condition of the engine 1. In this control, the ECU 30 particularly controls both timing and period of air injection which is performed by the air injection valve 44. With this control, the fuel spray penetration distance, spray velocity, spray particle diameter, spray angle, and spray shape can be changed according to a difference in operating conditions of the direct injection type engine 1 and there can be obtained a fuel spray having characteristics best suited to the operating condition determined. As a result, it is possible to supply a fuel spray suited to the operating condition of the engine 1 that changes a combustion type according to the operating condition, and the combustion characteristic of fuel can be improved in each combustion chamber 2 of the engine 1, which makes it possible to improve the exhaust emission of the engine 1 and improve the fuel economy and the engine power.

A description will now be given of a mechanism of controlling the spray penetration distance. As shown in FIG.

14, it is when the air injection time is set equal to the fuel injection time and the air injection period is set equal to the fuel injection period by controlling the opening/closing timing of the fuel injection valve 43 and the air injection valve 44 that the spray penetration distance becomes relatively short. This is because air jets formed simultaneously with the formation of a fuel spray act as resistance to the fuel spray. On the other hand, as shown in FIGS. 15 and 16, it is when the air injection timing is allowed to precede or somewhat precede the fuel injection timing by controlling the opening/closing timing of the fuel injection valve 43 and the air injection valve 44 that the spray penetration distance becomes relatively long. This is because air jets formed ahead of or somewhat ahead of a fuel spray impart vigor to the fuel spray. Therefore, by changing the degree of precedence of the air injection timing relative to the fuel injection timing it is possible to change the spray penetration distance.

Figure 20A:
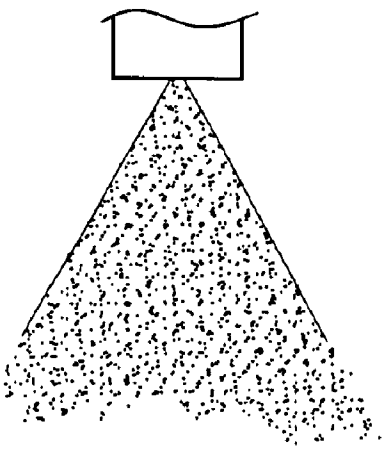
FIGS. 20A to 20C are explanatory diagrams showing different penetration distances in fuel spray.
Figure 20B:
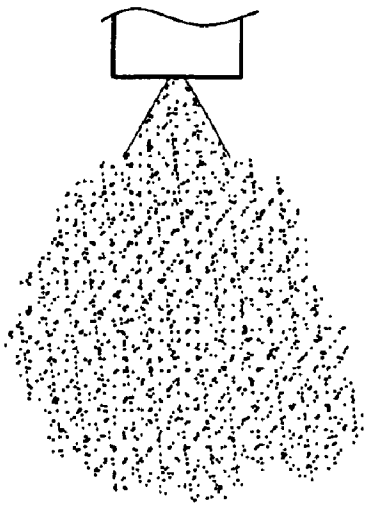
Figure 20C:
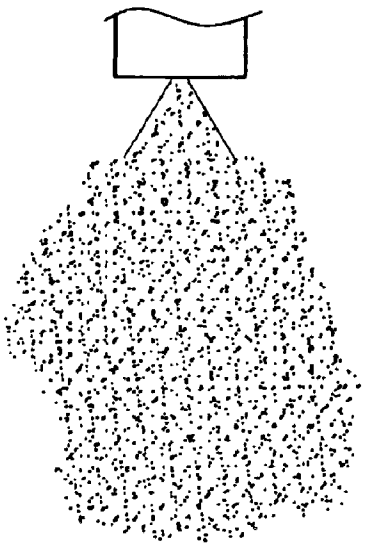

FIGS. 20A to 20C show control examples for the spray penetration distance, in which there are illustrated states of fuel sprays formed by using the fuel injection device 3. More specifically, FIG. 20A shows a fuel spray formed without air injection at the time of fuel injection. FIG. 20B shows a fuel spray formed by allowing air injection to precede fuel injection by "1.0 ms." FIG. 20C shows a fuel spray formed by allowing air injection to precede fuel injection by "2.0 ms." From FIGS. 20A to 20C it is seen that the more preceded air injection relative to fuel injection, the longer the spray penetration distance relatively.

Next, a description will be given of a mechanism of controlling the spray particle diameter. As shown in FIGS. 14 to 16, it is in all of the cases where the relation between the air injection timing and the fuel injection timing and the relation between the air injection period and the fuel injection period are changed by controlling the opening/closing timing of the fuel injection valve 43 and the air injection valve 44 that the spray particle size becomes relatively small. This is because in all of the cases the fuel spray particles are divided by collision of air jets with the fuel spray.

Next, a description will be given of a mechanism of controlling the spray angle and the spray shape. As shown in FIGS. 14 to 16, it is in all of the cases where the relation between the air injection timing and the fuel injection timing and the relation between the air injection period and the fuel injection period are changed by controlling the opening/closing timing of the fuel injection valve 43 and the air injection valve 44 that the spray angle and the spray shape change. As shown in FIG. 13, the reason why the spray angle becomes large ("Large spray angle") by the control for "Warm-up combustion" is that the fuel/air injection periods are the same and the fuel injection timings are the same and that therefore the dispersion to the environs upon fuel-air collision is improved. As shown in FIG. 13, the reason why the spray angle becomes small ("Small spray angle") by the control for "stratified charge combustion" is that, by allowing air injection to precede fuel injection, a fuel spray extends in the direction of fuel injection while being carried by a current of air, resulting in the spray penetration distance becoming long, while in the width direction the expanse of the fuel spray becomes small in inverse proportion to the increase of length even upon collision therewith of air. As shown in FIG. 13, the reason why the spray angle becomes medium ("Medium spray angle") by the control for "uniform combustion" is that the degree of precedence of air injection is smaller than that in "stratified charge combustion."

In connection with the above fuel injection control for "warm-up combustion," "stratified charge combustion," and "uniform combustion," descriptions have been given of the case where a change in fuel/air injection timings and a change in fuel/air injection periods are combined with each other, but in the case where the fuel/air injection timings and the fuel/air injection periods are changed each independently, it is presumed that there will be obtained the following functions and effects.

When the ECU 30 makes control to let the timing of air injection performed by the air injection valve 44 precede the timing of fuel injection performed by the fuel injection valve 43, the fuel spray penetration distance becomes long relatively, while the fuel spray particle diameter becomes relatively small, and there is obtained a fuel spray having characteristics suitable for stratified charge combustion. As a result, it is possible to improve the fuel combustion performance of the engine 1.

When the ECU 30 makes control to let the air injection period by the air injection valve 44 be equal to the fuel injection period by the fuel injection valve 43, the fuel spray particle diameter becomes relatively small throughout the whole fuel injection period, whereby it is possible to improve the fuel combustion performance of the engine 1.

Further, when the ECU 30 makes control to let the air injection period by the air injection valve 44 be longer than the fuel injection period by the fuel injection valve 43, the fuel spray penetration distance becomes relatively long and the spray particle diameter becomes relatively small throughout the whole region of the fuel spray, whereby it is possible to improve the fuel combustion performance of the engine 1.

Hereinafter, an additional description will be given about the functions and effects of the fuel injection control device for an internal combustion engine in the present embodiment.

Figure 21:
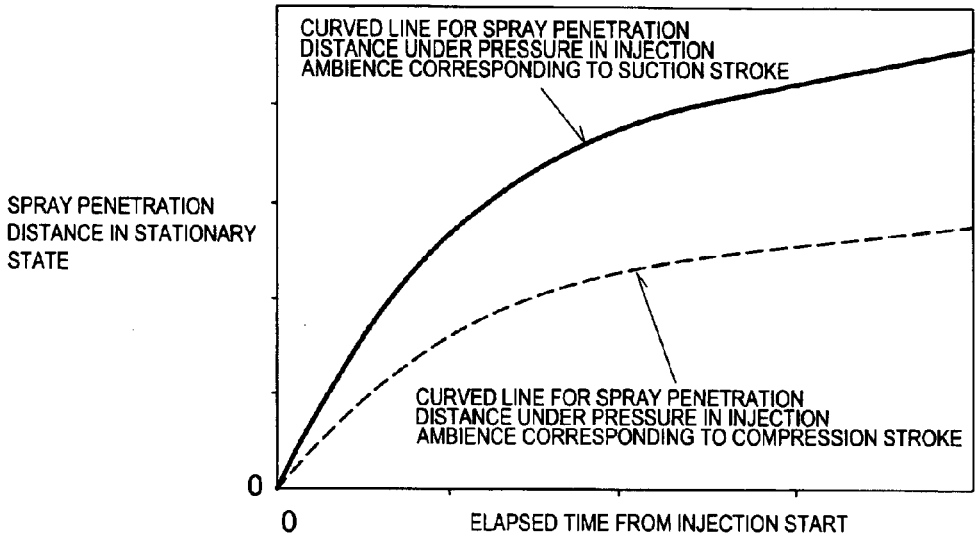
FIG. 21 is a graph showing a relation between an elapsed time after injection start and a spray penetration distance.

FIG. 21 is a graph of curved lines showing variations in spray penetration distance of fuel injected in a stationary state. In this graph, a continuous line indicates a spray penetration distance under the pressure in an injection ambience corresponding to the engine suction stroke, while a broken line indicates a spray penetration distance under the pressure in an injection ambience corresponding to the engine compression stroke. From this graph, it is seen that an increasing rate of the spray penetration distance becomes smaller with time after fuel injection start. This results from that inertia force of the injected fuel spray in the injection direction is reduced by frictional resistance of the air to the fuel spray and dispersion of the fuel spray and that the spray particle diameter is reduced by evaporation with time, thus causing an increase in air resistance.

Figure 22:
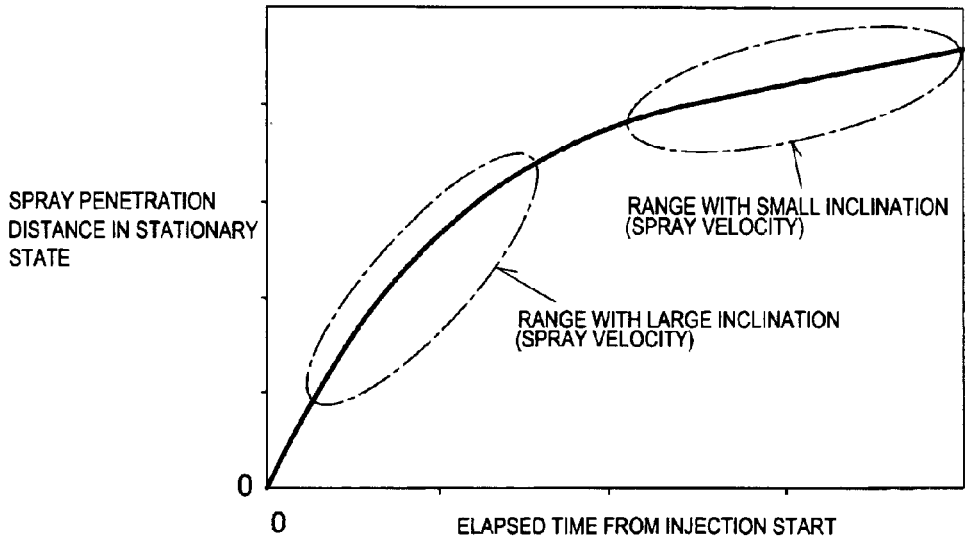
FIG. 22 is a graph showing a relation between an elapsed time after injection start and a spray penetration distance.

From the graph in FIG. 21, on the other hand, it is seen that the pressure becomes relatively high in the injection ambience corresponding to the compression stroke and therefore the spray penetration distance in a predetermined elapsed time after fuel injection start becomes relatively short as compared with that in the injection ambience corresponding to the suction stroke. The fuel spray injected in the suction stroke will collide with the crown of the piston and the wall surface of the bore (the wall surface of the combustion chamber) after a lapse of a predetermined time. As shown in FIG. 22, in a range where the curved line of a varying spray penetration distance has a relatively large inclination, the spray velocity becomes relatively high. Accordingly, when the fuel spray collides with the wall surface of the combustion chamber, fuel firmly adheres to that wall surface, leading to a decrease in HC emission and an increase in fuel economy. As shown by the curved line in FIG. 22, on the other hand, in a range where the curved line of a varying spray penetration distance has a relatively small inclination, the inertia force of fuel spray becomes relatively small. Accordingly, fuel will not adhere to or, on the contrary, rebounds from the wall surface of the combustion chamber even when a fuel spray collides with that wall surface and thus the fuel will highly be dispersed to form a combustible air-fuel mixture suitable for the uniform combustion.

In the case of the stratified charge combustion in which fuel is injected mainly in the engine compression stroke, the fuel spray collides with the crown of the piston at an earlier stage than in the case of the uniform combustion. To form a collected combustible air-fuel mixture required for the stratified charge combustion, however, it is necessary to let the fuel spray collide with the crown of the piston at a high velocity such as to prevent the fuel spray from rebounding from the piston crown and being dispersed even when the fuel spray collides with the piston crown. In this case, it is further preferable that the fuel spray has a small particle diameter so as to prevent fuel from adhering to the wall surface.

To attain the above technique, there is a method of adjusting fuel injection timings. In the fuel injection valve with no function to provide variable fuel spray, the injection timings are restricted by an engine rotational speed, engine type, and fixed injection conditions. This fuel injection valve could not fulfill the above mentioned functions sufficiently.

In the present embodiment, the spray penetration distance, spray velocity, spray particle diameter, spray angie, and spray shape are made variable so that the fuel spray can be controlled into an adequate state for an operating condition of the engine 1.

Figure 23:
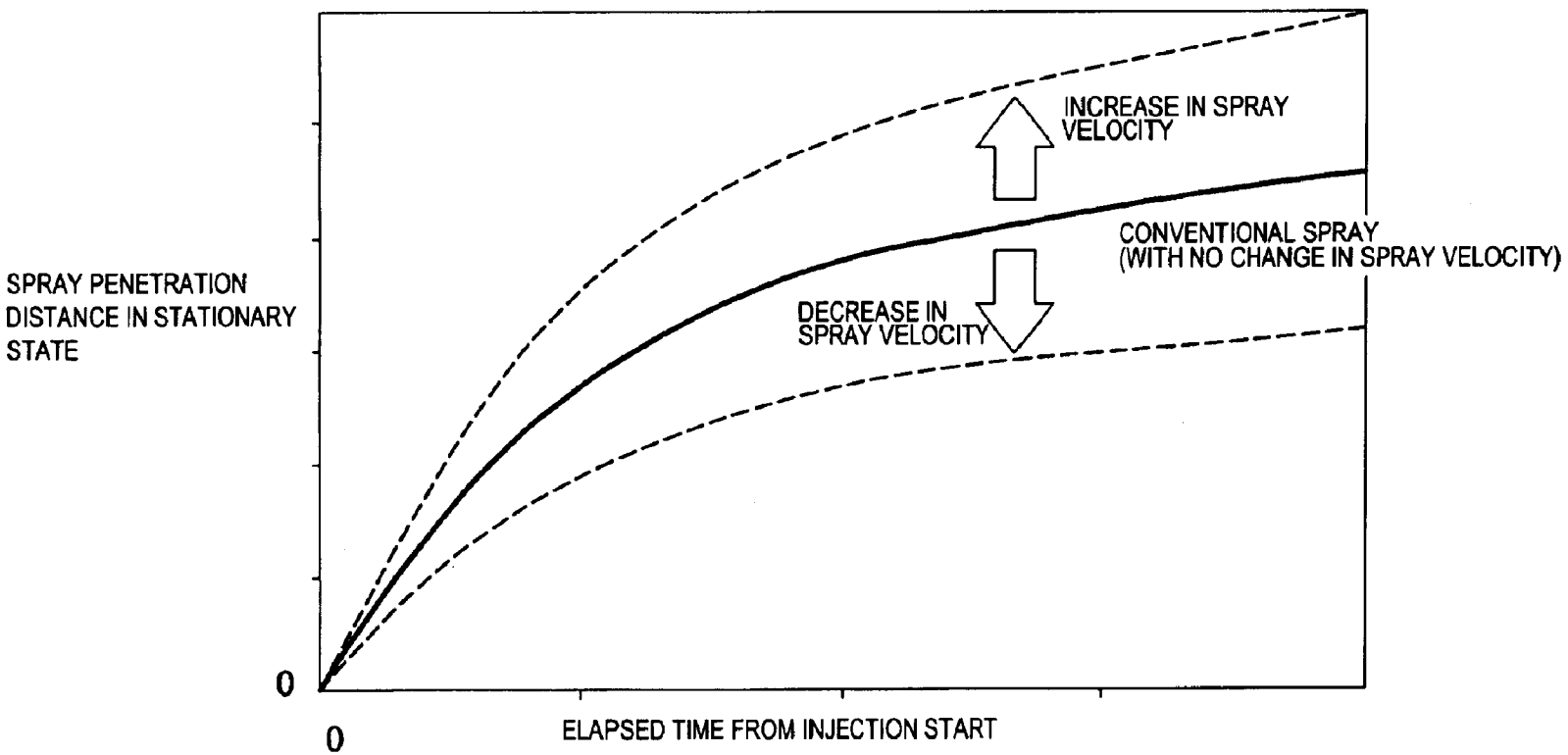
FIG. 23 is a graph showing a relation between an elapsed time after injection start and a spray penetration distance.

In the present embodiment, the spray velocity is made variable. Thus, the spray velocity to the same elapsed time after fuel injection start is changed (1) to decrease (alternatively, increase for the stratified charge combustion) at almost the same rate as compared with that for the conventional fuel injection or (2) to vary at different rates. The above method (1) is for controlling the spray velocity such that it becomes a spray velocity obtained by multiplying a spray velocity for a conventional fuel spray by a coefficient (the same rate) as shown in FIG. 23. This corresponds to for example the case where only the spray angle mentioned later is made variable and the case where only atomization of fuel spray is variably controlled. The above method (2) is for controlling the spray velocity independently of a spray velocity for a conventional fuel spray. This method is more effective and can be achieved with the use of the air blast type fuel injection device 3 in the present embodiment.

In the present embodiment, the spray particle diameter is made variable, which provides the following advantages. When the spray particle diameter is made relatively small, a suction efficiency and a combustion efficiency can be improved by evaporative cooling. As the spray particle diameter becomes relatively small, air resistance to the fuel spray becomes large, so that the spray velocity can be controlled variably. The spray velocity can change at almost the same rate as the spray velocity for the conventional fuel spray as shown in FIG. 23.

In the present embodiment, the spray angle is made variable, which provides the following advantages. When the spray angle is made moderately large, a combustible air-fuel mixture can be formed easily throughout the combustion chamber for uniform combustion. When the spray angle is made relatively small, a collected combustible air-fuel mixture required for stratified charge combustion can be formed easily. Further, a fuel injection flow quantity in the injection direction is correspondingly changed by an amount corresponding to a change in spray angle, and thus the spray velocity can be controlled variably. The spray velocity will change at almost the same rate as the spray velocity for the conventional fuel spray.

In the present embodiment, in the uniform combustion, when the engine rotational speed is low (for example, during idle running), there is enough time in a fuel injection period (for example, the engine rotational speed is "1000 rpm" and the suction stroke period is "about 30 ms"). By advancing the fuel injection timing, a fuel spray can somewhat be prevented from strongly colliding with the piston crown. The reason why the word "somewhat" is used is that the conventional fuel injection method could not sufficiently improve engine performances because the spray velocity is extremely higher than the moving speed of the piston and therefore the fuel spray even when injected following the motion of the piston will collide with the piston before the spray velocity is not sufficiently reduced (a collision place is a bottom dead point at the maximum). The spray velocity in the present embodiment is reduced as shown in FIG. 23 as compared with that in the conventional fuel injection method, so that the spray penetration distance can become relatively small. Accordingly, a period to advance the fuel injection timing is made large and the spray velocity can also be reduced. Even at collision, a combustible air-fuel mixture adequate for the uniform combustion can be formed as mentioned above.

Figure 24:
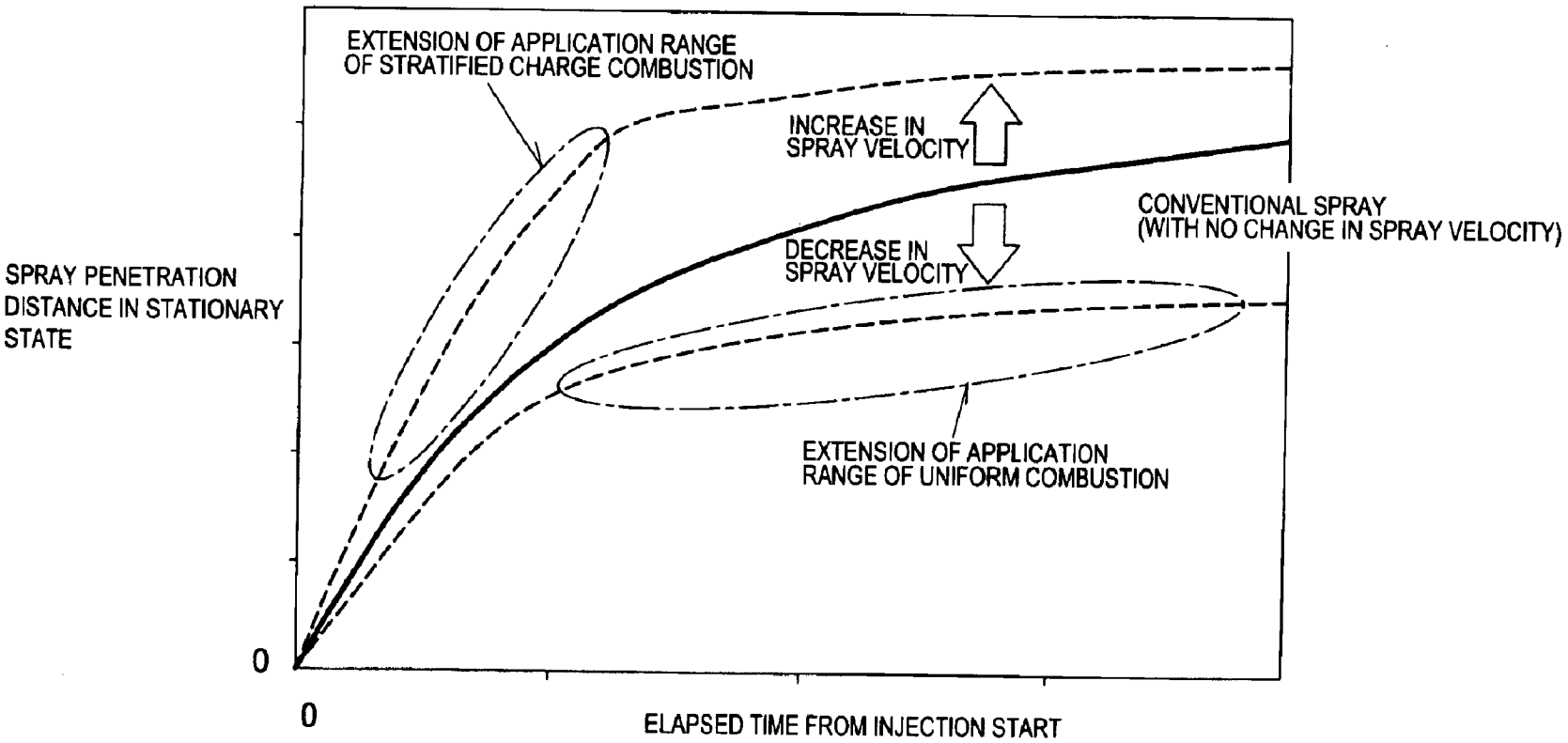
FIG. 24 is a graph showing a relation between an elapsed time after injection start and a spray penetration distance.

In the uniform combustion, when the engine rotational speed is high (for example, near a throttle valve full-open state), there is not enough time in a fuel injection period (for example, the engine rotational speed is "600 rpm" and the suction stroke period is "about 5 ms") and therefore a large quantity of fuel has to be injected. Thus, it is necessary to spread the fuel spray throughout the combustion chamber in the shortest time after fuel injection start and reduce the spray velocity soon thereafter. In this case, it is very effective that the spray velocity is controlled not only to be reduced as shown in FIG. 23, but also to be increased for a short time after fuel injection start as shown in FIG. 24, thereby increasing the spray penetration distance, and thereafter to be sharply dropped.

In the stratified charge combustion, on the other hand, a fuel spray tends to often collide with the piston crown and others just after fuel injection start. It is preferable that the spray velocity is made high for a short time after the fuel injection start. The larger a controllable range of the spray velocity, the larger allowable range of fuel injection timing is provided, thereby facilitating the fuel combustion control. Therefore, as shown in FIG. 23, it is more effective in the case where the spray velocity is highly controlled as compared with for the conventional fuel spray.

[Second Embodiment]

Next, a fuel injection control device for an internal combustion engine according to a second embodiment of the present invention will be described in detail below with reference to associated drawings.

In the subsequent embodiments including the second embodiment, the same components as in the first embodiment are identified by the same reference numerals as those in the first embodiment and explanations thereof will be omitted. The following description will mainly be given of different points.

Figure 25:
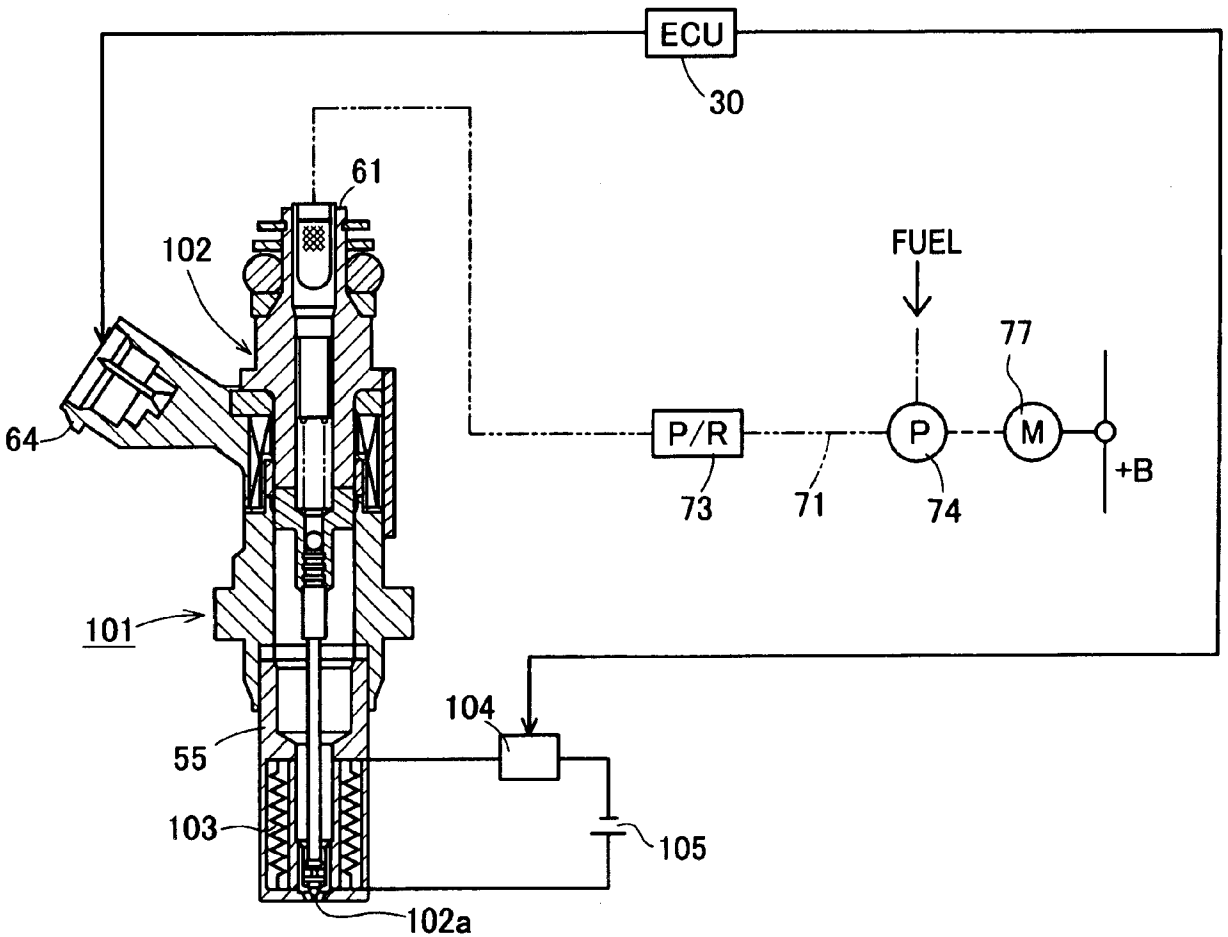
FIG. 25 is a conceptual construction diagram showing a heating type fuel injection device and others in a second embodiment.

The second embodiment differs from the first embodiment in the construction using a fuel heating type fuel injection device and a control device thereof, instead of using the air blast type fuel injection device 3. FIG. 25 is a conceptual construction diagram showing a heating type fuel injection device 101 and an associated electric wiring and fuel pipe. As shown in FIG. 25, the heating type fuel injection device 101 includes a fuel injection valve 102 which is formed with a fuel injection orifice 102*a* opening into the combustion chamber 2 and for injecting pressurized fuel into the combustion chamber 2 from the orifice 102*a*, and a resistance heater 103 serving as fuel heating means to heat fuel which is injected by the fuel injection valve 102. The heater 103 is built in a leading end (a lower end in FIG. 25) of the lower body 55 constituting the fuel injection valve 102. A pipe connector 61 in the fuel injection valve 102 is connected to a fuel pipe 71 in which a pressure regulator 73 and a fuel pump 75 are provided. The pump 74 is activated by an associated motor 77. When the pump 74 is activated, fuel is discharged from a fuel tank (not shown) through the pump 74 and is fed as a constant high-pressurized fuel to the fuel injection valve 102.

As shown in FIG. 25, the wiring connector 64 in the fuel injection valve 102 is electrically connected to the ECU 30. The fuel injection valve 102 operates based on an injection signal transmitted from the ECU 30. By operation of the fuel injection valve 102 based on the injection signal from the ECU 30, the high-pressurized fuel is injected from the injection valve 102.

As shown in FIG. 25, the heater 103 is connected in series with an electric current control unit 104 and a power source 105. The electric current control unit 104 is electrically connected to the ECU 30 and operates based on a heating signal transmitted from the ECU 30. By operation of the electric current control unit 104 based on the heating signal from the ECU 30, the heater 103 is energized to produce heat, thereby heating the fuel to be injected from the fuel injection valve 102.

Figure 26:
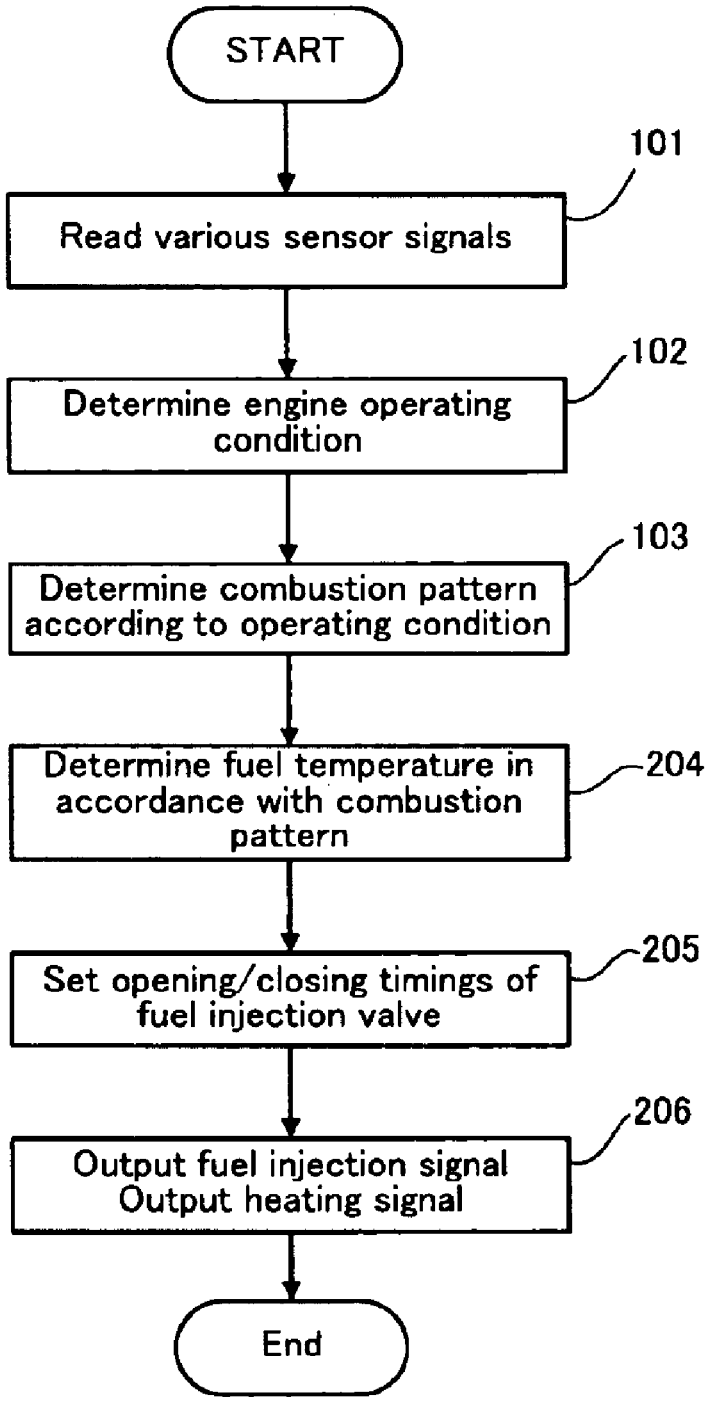
FIG. 26 is a flow chart showing a fuel injection control routine.

A description will be made on the details of a fuel injection control processing which the ECU 30 executes for making the fuel spray penetration distance, spray velocity, spray particle diameter, spray angle, and spray shape variable. FIG. 26 shows an associated "fuel injection control routine" in the form of a flow chart. The ECU 30 executes this routine periodically at predetermined time intervals during operation of the engine 1.

First, the processing in each step 101–103 is the same as that in each step 101–103 in the flow chart of FIG. 12 described in the first embodiment.

In step 204 following step 103, the ECU 30 determines the temperature of fuel to be heated by the heater 30 in accordance with the established combustion pattern. For example, in the case of "warm-up combustion", the "fuel temperature" is determined at "High" as shown in FIG. 27. Likewise, in the case of "stratified charge combustion", the "fuel temperature" is determined at "Low" as shown in FIG. 27. In the case of "uniform combustion", the "fuel temperature" is determined at "Medium" as shown in FIG. 27.

In step 205, the ECU 30 sets opening and closing timings of the fuel injection valve 102 corresponding to a change in crank angle in accordance with the established combustion pattern.

In step 206, the ECU 30 outputs a fuel injection signal representing the above set opening and closing timings to the fuel injection valve 102, while outputs a heating signal representing the above determined fuel temperature to the heater 103.

As above, the heater 103 is controlled in accordance with the combustion pattern, whereby changing the temperature of fuel to be injected from the fuel injection valve 102. When the fuel temperature is thus changed, fuel drops become easy to evaporate and the fuel particle diameter is reduced. Therefore the spray velocity, spray particle diameter, and spray angle can be controlled variably. In the present embodiment, the fuel heating type fuel injection device 101 constitutes spray velocity changing means, spray particle diameter changing means, spray angle changing means, and injection timing changing means of the present invention.

More specifically, for "warm-up combustion", as shown in FIG. 27, by setting the fuel temperature at "High", there are obtained spray characteristics such that the spray penetration distance is relatively short, the spray velocity is relatively low at the time of collision with the wall surface of the combustion chamber 2, the spray particle diameter is relatively small, and the spray shape has a large spray angle due to promotion of evaporation. A largest effect of the changes in the spray velocity is an increased air resistance resulting from the spray atomization, thereby bringing about an effect of reducing the spray velocity.

For "stratified charge combustion", as shown in FIG. 27, by setting the fuel temperature at "Low", there are obtained fuel spray characteristics such that the spray penetration distance is relatively long, the spray velocity is relatively high at the time of collision with the wall surface, the spray particle diameter is relatively large, and the spray shape has a small spray angle.

In the "uniform combustion", furthermore, as shown in FIG. 27, by setting the fuel temperature at "Medium", there are obtained fuel spray characteristics such that the spray penetration distance is relatively medium, the spray velocity is relatively medium at the time of collision with the wall surface, the spray particle diameter is relatively medium, and the spray shape has a medium spray angle.

Consequently, in the present embodiment, relative to the engine 1 which changes a combustion pattern according to an operating condition, a fuel spray adequate for the operating condition can be supplied to the engine 1, and the fuel combustion performances in the combustion chamber 2 in the engine 1 can be improved. Thus, the engine performances such as fuel economy, exhaust emission, and engine power can be improved.

[Third Embodiment]

Next, a fuel injection control device for an internal combustion engine according to a third embodiment of the present invention will be described in detail below with reference to associated drawings.

Figure 28:
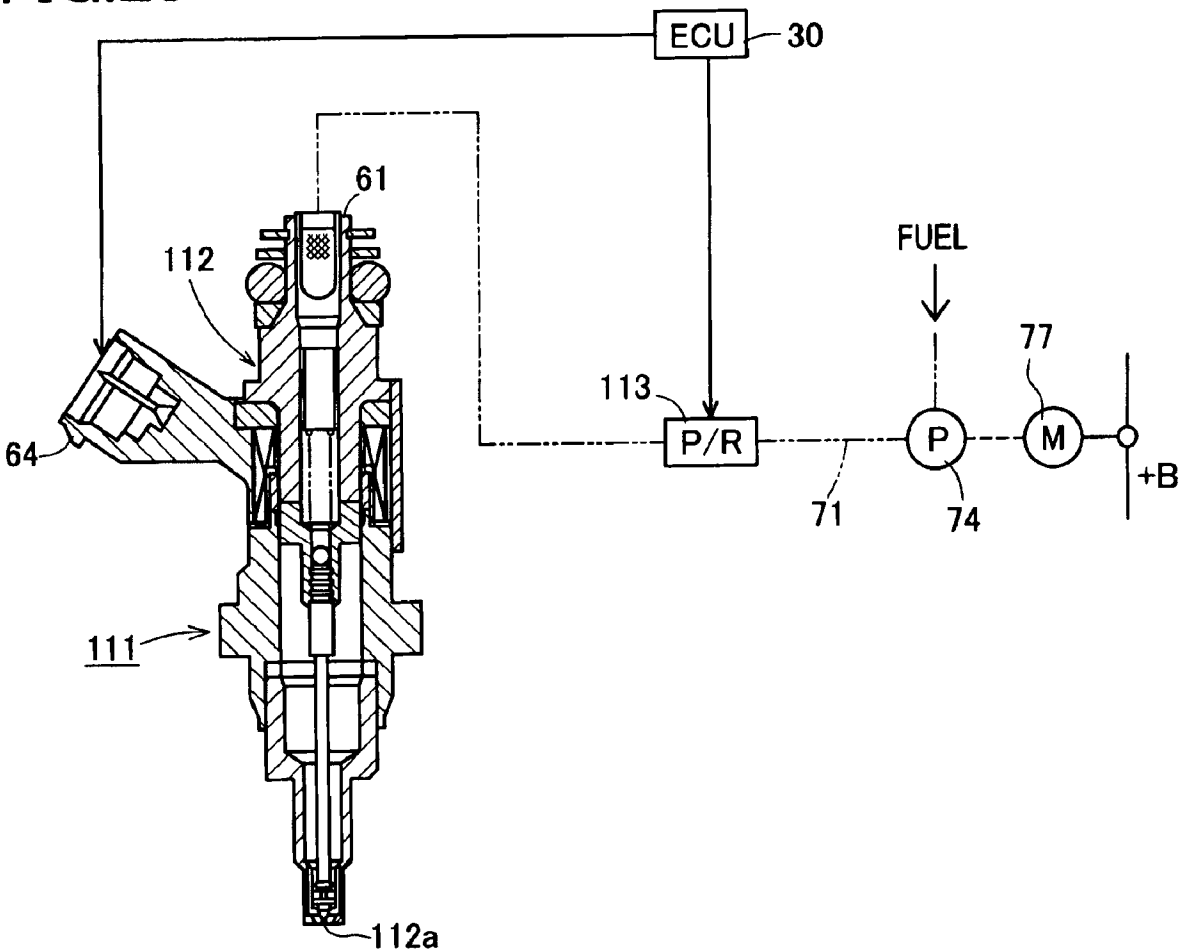
FIG. 28 is a conceptual construction diagram showing a variable fuel pressure type fuel injection device and others in a third embodiment.

This embodiment differs from the first embodiment in the construction using a variable fuel pressure type fuel injection device and a control device thereof, instead of using the air blast type fuel injection device 3. FIG. 28 is a conceptual construction diagram showing a variable fuel pressure type fuel injection device 111 and an associated electric wiring and fuel pipe. As shown in FIG. 28, the variable fuel pressure type fuel injection device 111 includes a fuel injection valve 112 which is formed with a fuel injection orifice 102*a* opening into the combustion chamber 2 and for injecting pressurized fuel into the combustion chamber 2 from the orifice 102*a*, and a variable pressure regulator 113 serving as fuel pressure changing means for changing the pressure of fuel to be supplied to the fuel injection valve 112. A pipe connector 61 in the fuel injection valve 112 is connected to a fuel pipe 71 in which the variable pressure regulator 113 and a fuel pump 74 are provided. The pump 74 is activated by an associated motor 77. When the pump 74 is activated, fuel is discharged from a fuel tank (not shown) through the pump 74 and is fed as a constant high-pressurized fuel to the fuel injection valve 112 through the variable pressure regulator 113.

As shown in FIG. 28, the wiring connector 64 in the fuel injection valve 112 is electrically connected to the ECU 30. The fuel injection valve 112 operates based on an injection signal transmitted from the ECU 30. By operation of the fuel injection valve 112 based on the injection signal from the ECU 30, the high-pressurized fuel is injected from the injection valve 112.

As shown in FIG. 28, the variable pressure regulator 113 is electrically connected with the ECU 30. The variable pressure regulator 113 operates based on a pressure signal transmitted from the ECU 30. By operation of the variable pressure regulator 113 based on the pressure signal from the ECU 30, the pressure of fuel to be supplied to the fuel injection valve 112 is changed.

Figure 29:
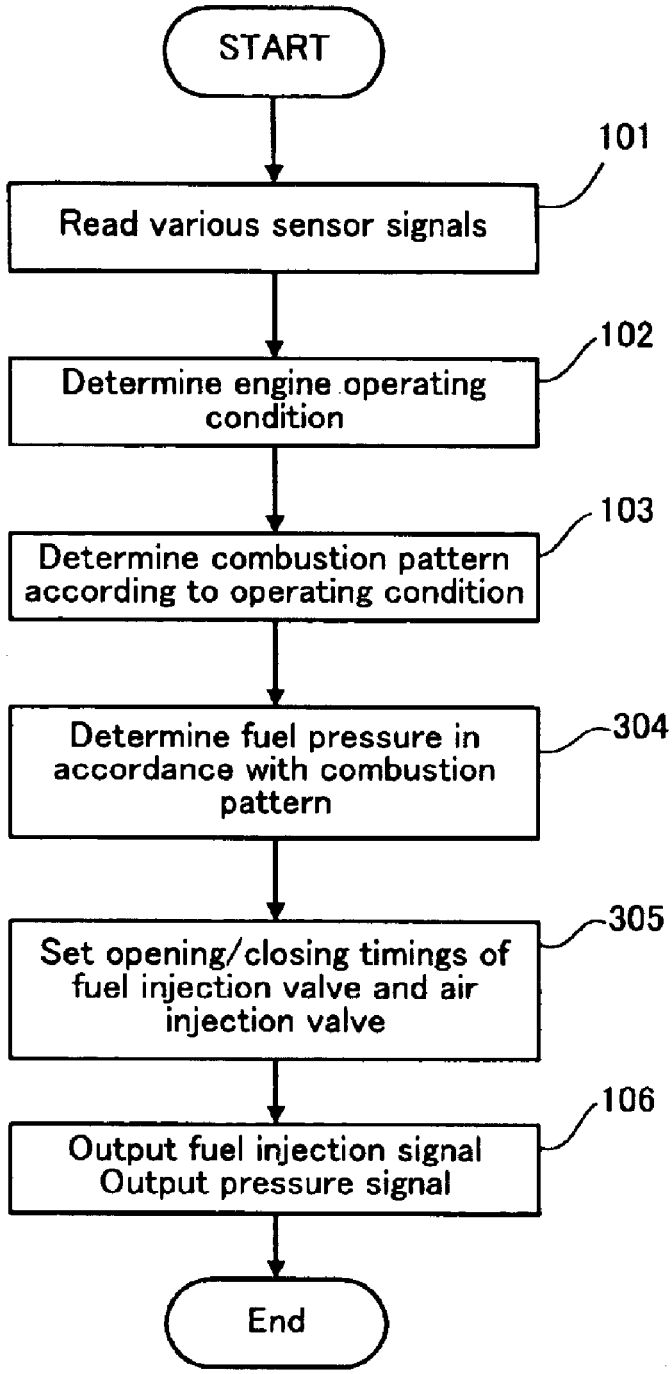
FIG. 29 is a flowchart showing a fuel injection control routine.

A description will be made on the details of a fuel injection control processing which the ECU 30 executes for making the fuel spray penetration distance, spray velocity, spray particle diameter, spray angle, and spray shape variable. FIG. 29 shows an associated "fuel injection control routine" in the form of a flow chart. The ECU 30 executes this routine periodically at predetermined time intervals during operation of the engine 1.

First, the processing in each step 101–103 is the same as that in each step 101–103 in the flow chart of FIG. 12 described in the first embodiment.

In step 304 following step 103, the ECU 30 determines the fuel pressure to be adjusted by the variable pressure regulator 113 in accordance with the established combustion pattern. For example, in the case of "warm-up combustion", the "fuel pressure" is determined at "Low" as shown in FIG. 30. Likewise, in the case of "stratified charge combustion", the "fuel pressure" is determined at "High" as shown in FIG. 30. In the case of "uniform combustion", furthermore, the "fuel pressure" is determined at "Medium" as shown in FIG. 30.

In step 305, the ECU 30 sets opening/closing timings of the fuel injection valve 112 corresponding to a change in crank angle in accordance with the established combustion pattern.

In step 306, the ECU 30 outputs a fuel injection signal representing the set opening and closing timings to the fuel injection valve 112, while outputs a pressure signal representing the determined fuel pressure to the variable pressure regulator 113.

As above, the variable pressure regulator 113 is controlled in accordance with the combustion pattern, whereby changing the pressure of fuel to be injected from the fuel injection valve 112. When the fuel pressure is thus changed, a fuel injection quantity per unit of time to be injected from the fuel injection valve 112 is changed and also fuel injection energy is changed. Therefore the spray velocity and spray particle diameter can be controlled variably. However, the spray angle does not particularly change because the effect resulting from the atomization of fuel spray and the effect resulting from the change in spray velocity cancel out each other. In the present embodiment, the variable fuel pressure type fuel injection device 111 constitutes the spray velocity changing means, spray particle diameter changing means, spray angle changing means, and spray timing changing means of the present invention.

More specifically, for "warm-up combustion", as shown in FIG. 30, by setting the fuel pressure at "Low", there are obtained spray characteristics such that the spray penetration distance is relatively short, the spray velocity is relatively low at the time of collision with the wall surface of the combustion chamber 2, the spray particle diameter is relatively large, and the spray shape is standard. As an effect of the changes in the spray velocity, an effect of increasing or decreasing the spray velocity can be brought about.

For "stratified charge combustion", on the other hand, as shown in FIG. 30, by setting the fuel pressure at "High", there are obtained fuel spray characteristics such that the spray penetration distance is relatively long, the spray velocity is relatively high at the time of collision with the wall surface, the spray particle diameter is relatively small, and the spray shape is standard.

In the "uniform combustion", furthermore, as shown in FIG. 30, by setting the fuel pressure at "Medium", there are obtained fuel spray characteristics such that the spray penetration distance is relatively medium, the spray velocity is relatively medium at the time of collision with the wall surface, the spray particle diameter is relatively medium, and the spray shape is standard.

Consequently, in the present embodiment, relative to the engine 1 which changes a combustion pattern according to an operating condition, a fuel spray adequate for the operating condition can be supplied to the engine 1, and the combustion performances in the combustion chamber 2 in the engine 1 can be improved. Thus, the engine performances such as fuel economy, exhaust emission, and engine power can be improved.

The present invention is not limited to the above embodiments, but a part of its construction may be altered appropriately, for example as follows, within the scope not departing from the gist of the invention.

Although in the first embodiment air is used as the gas which is brought into collision with fuel, there may be used any other specific gas than air.

Although in the second embodiment the heater 103 is provided in the fuel injection valve 102 as the fuel heating means to heat fuel, the fuel heating means may be provided in the fuel pipe directly before the fuel injection valve. Alternatively, for making sure of responsibility, the fuel heating means may be provided in each of plural fuel supply passages to heat fuel at different temperatures. In this case, the passages are selectively used.

In the second and third embodiments, the fuel heating type fuel injection device 101 and the variable fuel pressure type fuel injection device 111 are provided individually, but their functions may be combined. In this case, a variable range of fuel spray characteristics can relatively be extended.

In the above embodiments, the air blast type fuel injection device 3, the fuel heating type fuel injection device 101, and the variable fuel pressure type fuel injection device 111 are provided each to constitute all the spray velocity changing means, the spray particle diameter changing means, and the spray angle changing means of the present invention. Alternatively, there may be provided a fuel injection device that constitutes at least one of the spray velocity changing means, the spray particle diameter changing means, and the spray angle changing means of the present invention.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A fuel injection control device which is used in an internal combustion engine of a direct injection type in which fuel is directly injected into a combustion chamber, the fuel injection control device being adapted to selectively switch between a stratified charge combustion mode of collecting a fuel spray near a spark plug provided in the combustion chamber and a uniform combustion mode of uniformly dispersing a fuel spray throughout the combustion chamber, the fuel injection control device comprising:

spray velocity changing means for changing a velocity of the fuel spray, and at least one of spray particle diameter changing means for changing a particle diameter of the fuel spray and spray angle changing means for changing an angle of the fuel spray.

2. A fuel injection control device which is used in an internal combustion engine of a direct injection type in which fuel is directly injected into a combustion chamber, the fuel injection control device being adapted to selectively switch between a stratified charge combustion mode of collecting a fuel spray near a spark plug provided in the combustion chamber and a uniform combustion mode of uniformly dispersing a fuel spray throughout the combustion chamber, the fuel injection control device composing:

spray velocity changing means for changing a velocity of the fuel spray;

spray particle diameter changing means for changing a particle diameter of the fuel spray; and spray angle changing means for changing an angle of the fuel spray.

3. The fuel injection control device according to claim 1, further comprising:

operating condition detecting means for detecting an operating condition of the internal combustion engine; and control means for controlling the spray velocity changing means and at least one of the particle diameter changing means and the spray angle changing means to control the fuel spray velocity and at least one of the spray particle diameter and the fuel spray angle based on the operating condition detected by the operating condition detecting means.

4. The fuel injection control device according to claim 2, further comprising:

operating condition detecting means for detecting an operating condition of the internal combustion engine; and control means for controlling at least one of the spray velocity changing means, spray particle diameter changing means, and spray angle changing means to control the fuel spray velocity, fuel spray particle diameter, and fuel spray angle based on the operating condition detected by the operating condition detecting means.

5. The fuel injection control device according to claim 4, wherein the control means controls the spray velocity changing means, spray particle diameter changing means, and spray angle changing means in the uniform combustion mode so that the fuel spray velocity is relatively medium, the fuel spray particle diameter is relatively small, and the fuel spray angle is relatively medium.

6. The fuel injection control device according to claim 4, wherein the internal combustion engine includes a cylinder and a piston forming the combustion chamber, the fuel injection control device further comprises means for changing a fuel injection timing, and the control means controls the spray velocity changing means, spray particle diameter changing means, spray angle changing means, and injection timing changing means in the uniform combustion mode to control the fuel spray velocity, fuel spray particle diameter, and fuel spray angle in association with the fuel injection timing to such an extent as to make the fuel spray collide relatively weakly with a crown of the piston and an inner wall of the cylinder.

7. The fuel injection control device according to claim 4, wherein the control means controls the spray velocity changing means, spray particle diameter changing means, and spray angle changing means in the stratified charge combustion mode so that the fuel spray velocity is relatively high, the fuel spray particle diameter is relative small, and the fuel spray angle is relatively small.

8. The fuel injection control device according to claim 4, wherein the internal combustion engine includes a cylinder and a piston forming the combustion chamber, the fuel injection control device further comprises means for changing a fuel injection timing, and the control means controls the spray velocity changing means, spray particle diameter changing means, spray angle changing means, and injection timing changing means in the stratified charge combustion mode to control the fuel spray velocity, fuel spray particle diameter, and fuel spray angle in association with the fuel injection timing to such an extent as to make the fuel spray collide relatively strongly with a crown of the piston and an inner wall of the cylinder.

9. The fuel injection control device according to claim 2, wherein the spray velocity changing means, spray particle diameter changing means, and spray angle changing means are constituted by an air blast type fuel injection device including:

a fuel injection valve which has a fuel injection orifice opening into the combustion chamber and injects a pressurized fuel through the fuel injection orifice to the combustion chamber; and a gas injection valve which has a gas injection orifice opening into the combustion chamber and injects a pressurized gas through the gas injection orifice to the combustion chamber, the gas injection orifice and the fuel injection orifice being oriented to make the gas injected through the gas injection orifice collide with the fuel spray injected through the fuel injection orifice.

10. The fuel injection control device according to claim 4, wherein the spray velocity changing means, spray particle diameter changing means, and spray angle changing means are constituted by an air blast type fuel injection device including:

a fuel injection valve which has a fuel injection orifice opening into the combustion chamber and injects a pressurized fuel through the fuel injection orifice to the combustion chamber; and a gas injection valve which has a gas injection orifice opening into the combustion chamber and injects a pressurized gas through the gas injection orifice to the combustion chamber, the gas injection orifice and the fuel injection orifice being oriented to make the gas injected through the gas injection orifice collide with the fuel spray injected through the fuel injection orifice.

11. The fuel injection control device according to claim 5, wherein the spray velocity changing means, spray particle diameter changing means, and spray angle changing means are constituted by an air blast type fuel injection device including:

a fuel injection valve which has a fuel injection orifice opening into the combustion chamber and injects a pressurized fuel through the fuel injection orifice to the combustion chamber; and a gas injection valve which has a gas injection orifice opening into the combustion chamber and injects a pressurized gas through the gas injection orifice to the combustion chamber, the gas injection orifice and the fuel injection orifice being oriented to make the gas injected through the gas injection orifice collide with the fuel spray injected through the fuel injection orifice.

12. The fuel injection control device according to claim 6, wherein the spray velocity changing means, spray particle diameter changing means, and spray angle changing means are constituted by an air blast type fuel injection device including:

a fuel injection valve which has a fuel injection orifice opening into the combustion chamber and injects a pressurized fuel through the fuel injection orifice to the combustion chamber; and a gas injection valve which has a gas injection orifice opening into the combustion chamber and injects a pressurized gas through the gas injection orifice to the combustion chamber, the gas injection orifice and the fuel injection orifice being oriented to make the gas injected through the gas injection orifice collide with the fuel spray injected through the fuel injection orifice.

13. The fuel injection control device according to claim 7, wherein the spray velocity changing means, spray particle diameter changing means, and spray angle changing means are constituted by an air blast type fuel injection device including:

a fuel injection valve which has a fuel injection orifice opening into the combustion chamber and injects a pressurized fuel through the fuel injection orifice to the combustion chamber; and a gas injection valve which has a gas injection orifice opening into the combustion chamber and injects a pressurized gas through the gas injection orifice to the combustion chamber, the gas injection orifice and the fuel injection orifice being oriented to make the gas injected through the gas injection orifice collide with the fuel spray injected through the fuel injection orifice.

14. The fuel injection control device according to claim 8, wherein the spray velocity changing means, spray particle diameter changing means, and spray angle changing means are constituted by an air blast type fuel injection device including:

a fuel injection valve which has a fuel injection orifice opening into the combustion chamber and injects a pressurized fuel through the fuel injection orifice to the combustion chamber; and a gas injection valve which has a gas injection orifice opening into the combustion chamber and injects a pressurized gas through the gas injection orifice to the combustion chamber, the gas injection orifice and the fuel injection orifice being oriented to make the gas injected through the gas injection orifice collide with the fuel spray injected through the fuel injection orifice.

15. The fuel injection control device according to claim 2, wherein the spray velocity changing means, spray particle diameter changing means, and spray angle changing means are constituted by a heating type fuel injection device including:

a fuel injection valve which has a fuel injection orifice opening into the combustion chamber and injects a pressurized fuel through the fuel injection orifice to the combustion chamber; and fuel heating means for heating the fuel to be injected.

16. The fuel injection control device according to claim 4, wherein the spray velocity changing means, spray particle diameter changing means, and spray angle changing means are constituted by a beating type fuel injection device including:

a fuel injection valve which has a fuel injection orifice opening into the combustion chamber and injects a pressurized fuel through the fuel injection orifice to the combustion chamber; and fuel heating means for heating the fuel to be injected.

17. The fuel injection control device according to claim 5, wherein the spray velocity changing means, spray particle diameter changing means, and spray angle changing means are constituted by a heating type fuel injection device including:

a fuel injection valve which has a fuel injection orifice opening into the combustion chamber and injects a pressurized fuel through the fuel injection orifice to the combustion chamber; and fuel heating means for heating the fuel to be injected.

18. The fuel injection control device according to claim 6, wherein the spray velocity changing means, spray particle diameter changing means, and spray angle changing means are constituted by a heating type fuel injection device including:

a fuel injection valve which has a fuel injection orifice opening into the combustion chamber and injects a pressurized fuel through the fuel injection orifice to the combustion chamber; and fuel heating means for heating the fuel to be injected.

19. The fuel injection control device according to claim 7, wherein the spray velocity changing means, spray particle diameter changing means, and spray angle changing means are constituted by a heating type fuel injection device including:

a fuel injection valve which has a fuel injection orifice opening into the combustion chamber and injects a pressurized fuel through the fuel injection orifice to the combustion chamber; and fuel heating means for heating the fuel to be injected.

20. The fuel injection control device according to claim 8, wherein the spray velocity changing means, spray particle diameter changing means, and spray angle changing means are constituted by a heating type fuel injection device including:

a fuel injection valve which has a fuel injection orifice opening into the combustion chamber and injects a pressurized fuel through the fuel injection orifice to the combustion chamber; and fuel heating means for heating the fuel to be injected.

21. The fuel injection control device according to claim 2, wherein the spray velocity changing means, spray particle diameter changing means, and spray angle changing means are constituted by a variable fuel pressure type fuel injection device including:

a fuel injection valve which has a fuel injection orifice opening into the combustion chamber and injects a pressurized fuel through the fuel injection orifice to the combustion chamber; and fuel pressure changing means for changing a pressure of the fuel to be supplied to the fuel injection valve.

22. The fuel injection control device according to claim 4, wherein the spray velocity changing means, spray particle diameter changing means, and spray angle changing means are constituted by a variable fuel pressure type fuel injection device including:

a fuel injection valve which has a fuel injection orifice opening into the combustion chamber and injects a pressurized fuel through the fuel injection orifice to the combustion chamber; and fuel pressure changing means for changing a pressure of the fuel to be supplied to the fuel injection valve.

23. The fuel injection control device according to claim 5, wherein the spray velocity changing means, spray particle diameter changing means, and spray angle changing means are constituted by a variable fuel pressure type fuel injection device including:

a fuel injection valve which has a fuel injection orifice opening into the combustion chamber and injects a pressurized fuel through the fuel injection orifice to the combustion chamber; and fuel pressure changing means for changing a pressure of the fuel to be supplied to the fuel injection valve.

24. The fuel injection control device according to claim 6, wherein the spray velocity changing means, spray particle diameter changing means, and spray angle changing means are constituted by a variable fuel pressure type fuel injection device including:

a fuel injection valve which has a fuel injection orifice opening into the combustion chamber and injects a pressurized fuel through the fuel injection orifice to the combustion chamber; and fuel pressure changing means for changing a pressure of the fuel to be supplied to the fuel injection valve.

25. The fuel injection control device according to claim 7, wherein the spray velocity changing means, spray particle diameter changing means, and spray angle changing means are constituted by a variable fuel pressure type fuel injection device including:

a fuel injection valve which has a fuel injection orifice opening into the combustion chamber and injects a pressurized fuel through the fuel injection orifice to the combustion chamber; and fuel pressure changing means for changing a pressure of the fuel to be supplied to the fuel injection valve.

26. The fuel injection control device according to claim 8, wherein the spray velocity changing means, spray particle diameter changing means, and spray angle changing means are constituted by a variable fuel pressure type fuel injection device including:

a fuel injection valve which has a fuel injection orifice opening into the combustion chamber and injects a pressurized fuel through the fuel injection orifice to the combustion chamber; and fuel pressure changing means for changing a pressure of the fuel to be supplied to the fuel injection valve.

* * * * *